US010513912B2

(12) United States Patent
Slocum et al.

(10) Patent No.: US 10,513,912 B2
(45) Date of Patent: Dec. 24, 2019

(54) METHOD AND APPARATUS FOR BRINGING UNDER CONTROL AN UNCONTROLLED FLOW THROUGH A FLOW DEVICE

(71) Applicants: Alexander Henry Slocum, Bow, NH (US); Folkers Eduardo Rojas, Boston, MA (US)

(72) Inventors: Alexander Henry Slocum, Bow, NH (US); Folkers Eduardo Rojas, Boston, MA (US)

( * ) Notice: Subject to any disclaimer, the term of this patent is extended or adjusted under 35 U.S.C. 154(b) by 360 days.

(21) Appl. No.: 15/665,244

(22) Filed: Jul. 31, 2017

(65) Prior Publication Data

US 2017/0328182 A1 Nov. 16, 2017

Related U.S. Application Data

(63) Continuation of application No. 13/893,152, filed on May 13, 2013, now Pat. No. 9,719,331.

(60) Provisional application No. 61/646,319, filed on May 13, 2012.

(51) Int. Cl.

| | |
|---|---|
| ***E21B 41/04*** | (2006.01) |
| ***E21B 43/01*** | (2006.01) |
| ***E21B 33/068*** | (2006.01) |
| *E21B 33/06* | (2006.01) |

(52) U.S. Cl.

CPC ..... *E21B 41/04* (2013.01); *E21B 33/068* (2013.01); *E21B 43/0122* (2013.01); *E21B 33/06* (2013.01)

(58) Field of Classification Search

CPC ..... E21B 33/06; E21B 33/068; E21B 41/04; B21B 23/00; B21B 23/002; F15D 1/10; A61B 17/1214

USPC ..... 138/42

See application file for complete search history.

(56) References Cited

U.S. PATENT DOCUMENTS

| | | | |
|---|---|---|---|
| 2,525,590 | A | 10/1950 | Collins |
| 2,567,009 | A | 9/1951 | Calhoun et al. |
| 3,016,830 | A | 1/1962 | Kirby, II |
| 3,170,516 | A | 2/1965 | Holland et al. |
| 3,331,545 | A | 7/1967 | Oliveri |
| 3,447,730 | A | 6/1969 | Jeannette |
| 3,647,000 | A | 3/1972 | Rowley et al. |

(Continued)

FOREIGN PATENT DOCUMENTS

| | | |
|---|---|---|
| CN | 201963231 | 9/2011 |
| CN | 202140061 | 2/2012 |

(Continued)

OTHER PUBLICATIONS

IMPI, "MX Application No. MX/a/2015/015721 First Office Action dated Feb. 20, 2019", Mexican translations , 3 pages.

(Continued)

*Primary Examiner* — David Carroll
(74) *Attorney, Agent, or Firm* — Strategic Patents, P.C.

(57) ABSTRACT

A machine includes a spindle for storing wire, a wire passage structure having an interface coupline, a controllable drive system, a control system, and a pressure-resistant housing. The drive system is configured to feed the wire through the wire passage structure and through the interface coupling, under the control of the control system. The housing encloses the wire passage structure, the controllable drive system, and at least a portion of the control system.

12 Claims, 38 Drawing Sheets

(56) References Cited

U.S. PATENT DOCUMENTS

Figure 1A:
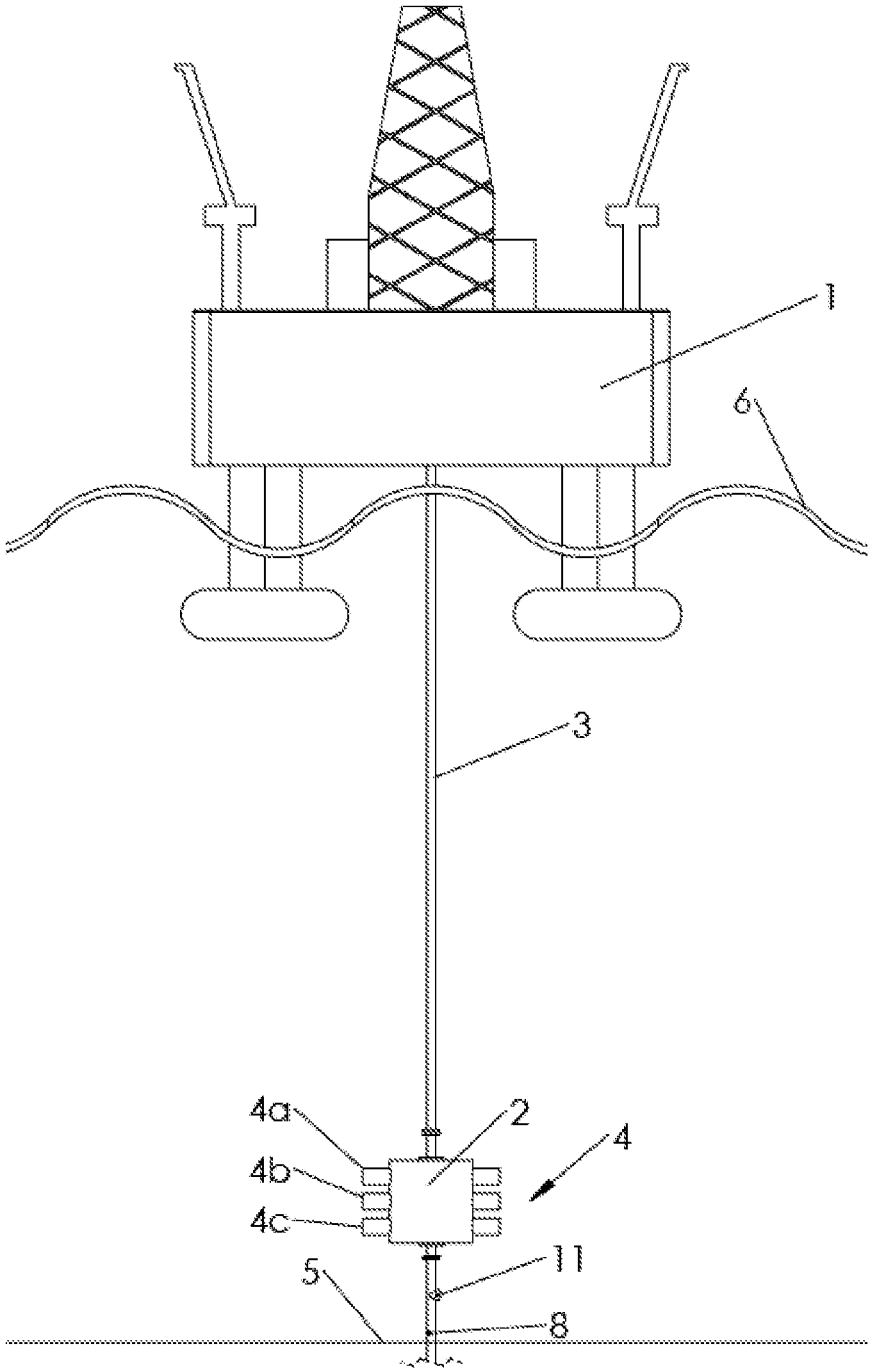

| | | | | |
|---|---|---|---|---|
| 3,738,424 | A | 6/1973 | Osmun et al. | |
| 3,901,425 | A | 8/1975 | Taylor | |
| 3,926,256 | A | 12/1975 | McCall | |
| 3,946,918 | A | 3/1976 | Babbin et al. | |
| 4,034,456 | A | 7/1977 | Bowers | |
| 4,133,383 | A | 1/1979 | Ely et al. | |
| 4,235,362 | A | 11/1980 | Hubenko et al. | |
| 4,275,788 | A | 6/1981 | Sweatman | |
| 4,324,505 | A | 4/1982 | Hammett et al. | |
| 4,447,247 | A | 5/1984 | Naess | |
| 4,475,594 | A | 10/1984 | Drake et al. | |
| 4,489,784 | A | 12/1984 | Messenger | |
| 4,585,061 | A | 4/1986 | Lyons et al. | |
| 5,434,003 | A | 7/1995 | Medeiros et al. | |
| 5,816,466 | A | 10/1998 | Seufer et al. | |
| 5,918,671 | A | 7/1999 | Bridges et al. | |
| 5,934,537 | A | 8/1999 | Miller et al. | |
| 5,980,554 | A * | 11/1999 | Lenker | A61B 17/12022 606/198 |
| 6,183,495 | B1 | 2/2001 | Lenker et al. | |
| 6,367,566 | B1 | 4/2002 | Hill et al. | |
| 6,427,894 | B1 | 8/2002 | Blank et al. | |
| 6,595,289 | B2 | 7/2003 | Tumlin et al. | |
| 7,026,574 | B2 | 4/2006 | Belfiore et al. | |
| 7,036,445 | B2 | 5/2006 | Kaufmann et al. | |
| 7,077,149 | B2 | 7/2006 | Kalley et al. | |
| 7,658,230 | B2 | 2/2010 | Kimiadi | |
| 8,025,103 | B1 | 9/2011 | Wolinsky | |
| 8,047,239 | B2 * | 11/2011 | Hoyaukin | E04G 21/122 140/119 |
| 8,371,373 | B2 | 2/2013 | Ba-Abbad | |
| 2005/0161549 | A1 | 7/2005 | Hainline | |
| 2009/0126942 | A1 | 5/2009 | Kimiadi et al. | |
| 2009/0133874 | A1 * | 5/2009 | Dale | E21B 43/088 166/278 |
| 2010/0018721 | A1 | 1/2010 | Jennings et al. | |
| 2011/0155277 | A1 | 6/2011 | Coles et al. | |
| 2011/0297394 | A1 | 12/2011 | VanDelden et al. | |
| 2012/0006802 | A1 | 1/2012 | Bae | |
| 2012/0046687 | A1 * | 2/2012 | Trommeter | A61B 17/12022 606/200 |
| 2012/0152560 | A1 | 6/2012 | O'Malley et al. | |
| 2012/0160509 | A1 | 6/2012 | Caldwell et al. | |
| 2012/0168161 | A1 | 7/2012 | Bowersock et al. | |
| 2012/0285683 | A1 * | 11/2012 | Hermes | E21B 33/02 166/295 |
| 2012/0285704 | A1 | 11/2012 | Mothaffar et al. | |
| 2013/0048621 | A1 | 2/2013 | Christopher et al. | |
| 2013/0126178 | A1 | 5/2013 | Kägi et al. | |
| 2013/0299195 | A1 | 11/2013 | Slocum et al. | |

FOREIGN PATENT DOCUMENTS

| | | |
|---|---|---|
| CN | 202266242 | 6/2012 |
| CN | 102758618 | 10/2012 |
| WO | WO-2011153245 | 12/2011 |
| WO | WO-2014186329 | 11/2014 |

OTHER PUBLICATIONS

SIPO, "CN Application No. 201480039967.9 First Office Action dated Oct. 30, 2017", English and Chinese translations , 20 pages.
Hamburger, Charles L. et al., "A Shear-Thickening Fluid for Stopping Unwanted Flows While Drilling", Society of Petroleum Engineers, Mar. 1985 , pp. 499-504.
"The OSPRAG Well Capping Device", Oil Spill Prevention and Response Advisory Group, Ed., ed. NPL-9 Aug. 2011 , 16 Pages.
"UKCS Well Capping Device", www.oilspillresponse.com/services-landing/well-incident-intervention/ukcs-well-capping-device, Jun. 7, 2013 , 2 pages.
Marine Well Containment Company, "Containment System", http://www.marinewellcontainment.com/containment.php, 2013, 1 Page.
USPTO, "U.S. Appl. No. 13/893,152, Final Office Action dated May 20, 2016", , 13 pages.
USPTO, "U.S. Appl. No. 13/893,152, Non-Final Office Action dated Oct. 22, 2015", , 15 pages.
USPTO, "U.S. Appl. No. 13/893,152, Non-Final Office Action dated Feb. 8, 2017", , 9 pages.
USPTO, "U.S. Appl. No. 13/893,152, Notice of Allowance dated Jun. 21, 2017", , 7 pages.
WIPO, "International Application Serial No. PCT/US14/37789, Preliminary Report on Patentability dated Nov. 26, 2015", , 8 pages.
ISA, "International Application Serial No. PCT/US2014037789, Search Report and Written Opinion dated Jan. 29, 2015", 11 pages.

* cited by examiner

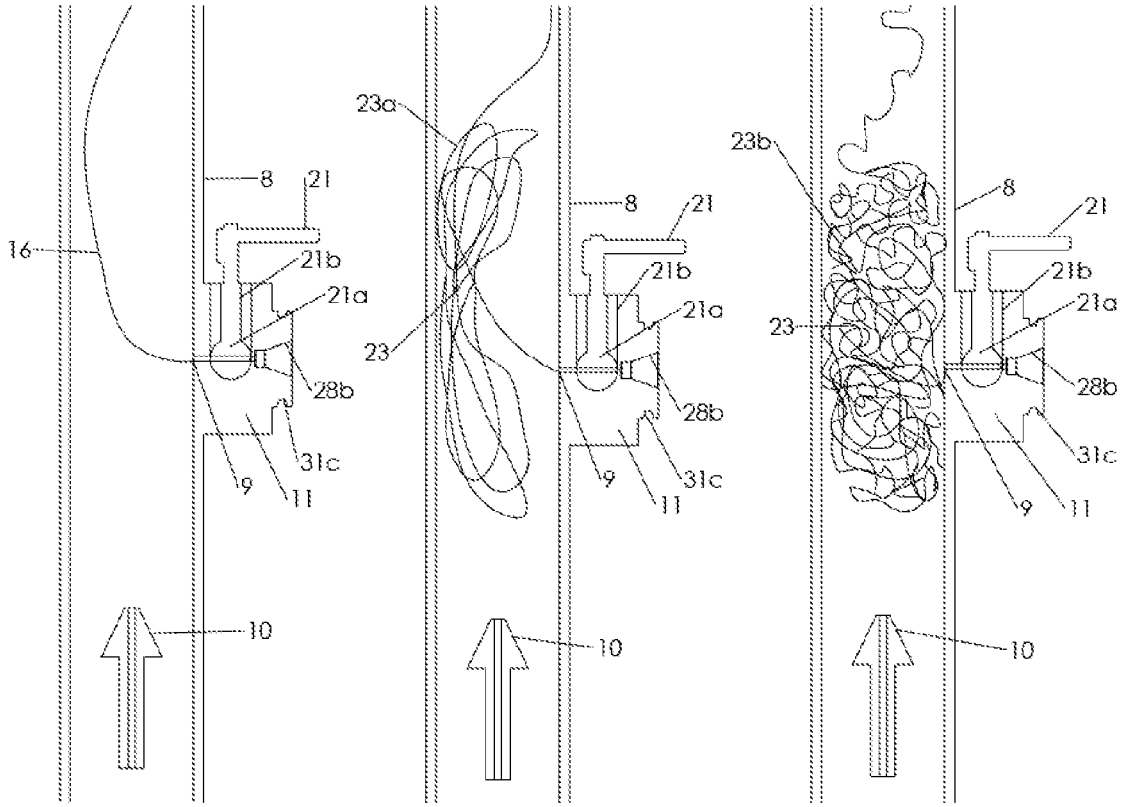
*Figure 11a* *Figure 11b* *Figure 11c*

METHOD AND APPARATUS FOR BRINGING UNDER CONTROL AN UNCONTROLLED FLOW THROUGH A FLOW DEVICE

RELATED APPLICATIONS

This application is a continuation of U.S. patent application Ser. No. 13/893,152, filed on May 13, 2013, which claims the benefit under 35 U.S.C. § 119(e) of U.S. Provisional Application No. 61/646,319 filed on May 13, 2012, where the entirety of each of the foregoing is hereby incorporated by reference herein.

TECHNICAL FIELD

This document relates to a method and apparatus for creating a flow resistance in a flow device to bring under control an uncontrolled fluid flow.

BACKGROUND

Currently, blowout preventers (BOPS) are the primary safety device for controlling a well in the case of an unwanted influx of formation fluids entering the well. When a BOP fails, currently the main recourses are to either inject a "junk shot" below the BOP to attempt to plug the flow through the BOP, or drill a relief well to pump in concrete at the base of the well to seal the high pressure region. The junk shot injects (pumps) large quantities of discrete pieces of material (e.g. pieces of rope, balls, etc.) with the intent that some of the materials will hang up on features inside the wellbore and then further bits of junk will build up behind; this approach is difficult because it can suddenly stop the flow and generate a pressure wave that can break the casing, rupture disks, and fracture the formation thus damaging the well and the reservoir. This can result in the entire reservoir being lost through the casing and fractured formation which then could catastrophically leak to the surface over a wide area. Drilling a relief well can take months to complete, during which time the well continues to produce out of control. Therefore, an alternative solution is needed to controllably close off uncontrolled flow through a damaged BOP.

OBJECTS OF THE DISCLOSURE

Among other objects, an object of the present disclosure is therefore to provide a new machine and method for incrementally reducing uncontrolled flow in a device by feeding a wire (defined here to include braided or unbraided wire, ribbon, chain, or any type of structure(s) or material(s) that can be continually fed from a storage device through a small hole in the flow device) into the flow device where it entangles to form a plug. In this document, the term "wire" also includes the structures described in U.S. Provisional Patent Application 61/646,328, filed May 13, 2012; and its child, a U.S. Patent Application whose number is not yet assigned, which claims priority to U.S. Pat. App. 61/646,328, filed the same day as this application. The entirety of each of these applications is hereby incorporated by reference.

Another object of the disclosure is to provide a machine for controllably feeding a wire into a free flowing wellbore for controllably reducing the flow and bringing the wellbore under control.

Still another object is to provide a machine, which can be coupled to a wellbore access point and when a blowout occurs, opens a valve to the wellbore and a valve to the machine to equalize the pressure inside the machine with the wellbore, which then allows the wire to be inserted.

Another object is to provide a flexible tube into the flow device to be plugged, to deliver the wire directly into the flow stream at a desired point.

Another object is to provide a method for feeding the wire using differential surface speed rollers to impart curl to the wire as it is fed into the wellbore.

Another object is to provide a method for forming the wire using rollers to impart features into the wire as it is fed into the wellbore.

Another object is to use the valves to cut the wire when closing the valve so as to allow the device to undock.

Another object is the ability to connect to existing BOP ports, such as the choke/kill lines.

Another object is to insert a proboscis into a BOP port and snake it to the point in the wellhead where the wire is to be deployed for form a plug.

Still another object of the invention is to provide a device that remains docked to the wellhead at or just below the BOP where it can be activated if the BOP fails to operate properly.

Other objects and consequences of the disclosure will be appreciated by one of ordinary skill in the art.

SUMMARY

In general, in one aspect, a machine includes: a spindle for storing wire; a wire passage structure having an interface coupling; a controllable drive system configured to feed the wire through the wire passage structure and through the interface coupling; a control system configured to cause the drive system to feed the wire at a controllable rate; and a pressure-resistant housing enclosing the wire passage structure, the controllable drive system, and at least a portion of the control system in an interior of the housing.

Implementations may have one or more of the following features. The drive system includes a pair of drive wheels, at least one of which is controllable. At least one drive wheel includes a surface texture such that when the wire is engaged with the at least one drive wheel at the surface, the wire is deformed by the surface texture. Also including a suspension mechanism configured to maintain a force between the pair of drive wheels. Each of the pair of drive wheels are mechanically coupled to each other, such that a relative velocity between the drive wheels is maintained. Each of the pair of drive wheels is controllable. Also including position control thrusters coupled to the housing. Also including a fluid other than air that fills the interior of the housing. Also including a pressurizing unit capable of controlling pressure in the interior of the housing. The control system is configured to equalize the pressure between the interior of the housing and a wellbore to which the machine is coupled. The control system is configured to control the pressure in the interior of the housing injecting and pressurizing environmental fluid into the interior of the housing. The wire passage structure includes a proboscis. Also including a proboscis feeder module.

In general, in another aspect, a proboscis feeder system includes: A proboscis having a body and a tail; a spindle coupled to the proboscis by the tail; and a drive system configured to drive the proboscis in a deployment direction.

Implementations may have one or more of the following features: Also including a housing that encloses the proboscis, the spindle, and the drive system in an interior of the housing; and The drive system includes a pressurizing system configured to drive the proboscis in the deployment direction by creating a pressure differential between the interior of the housing and a deployment environment. The drive system includes drive rollers configured to engage the proboscis at the body. A stiffness of the proboscis varies along the body in a desired fashion, thereby promoting a desired deformation. The spindle is further configured to hold a wire. The proboscis further includes at least one access valve along the body.

In general, in another aspect: coupling a machine to a flow device, wherein: the machine has a deployable stock of wire and a drive system configured to drive the wire in a deployment direction; the flow device includes fluid having a flow rate; continuously feeding wire into the flow device, thereby decreasing the flow rate, until a desired flow rate has been achieved.

Implementations may have one or more of the following features. Feeding the wire occurs upon a failure event. The failure event includes the flow rate increasing beyond a pre-defined threshold. The failure event includes a control failure of a safety component of the flow device. The machine has an interior, further comprising pressurizing the interior to a pressure equal to or greater than a pressure inside the flow device. The flow device includes a flowing medium, and wherein the continuously-fed wire forms an entangled structure when entering the flowing medium.

In summary the techniques described below serve to controllably bring under control an uncontrolled flow stream by feeding a continuous medium, such as a wire, into the flow stream where it entangles and builds up an ever-increasing flow resistance as more and more material is fed in. A continuous medium, such as a wire, has a high probability of entanglement thus creating an obstruction to flow. Entanglement is generated as the wire buckles inside the wellbore, but care is taken to ensure that the wire does not buckle outside the wellbore during the feeding process; therefore, the geometry of the feeding mechanism and clearance path of the wire are buckling-free zones. The driving mechanism also has the force necessary to buckle the wire inside of the flow stream, where there is often a high pressure differential between the inside of a wellbore and the outside, which is what drives high flow. The differential pressure acting on the wire cross sectional area can typically create a large force that will buckle even a small length of wire. Hence it is desirable to control the differential pressure between the wellbore and the inside of the machine; e.g., either arrange for this differential to be zero or positive from the machine into the wellbore so any differential pressure would help to carry the wire into the wellbore. In addition, the device includes the use of a "proboscis section," i.e. a flexible tube, fed into the flow device to be plugged, to deliver the wire directly into the flow stream at a desired point. The proboscis can navigate and extend into the BOP port and feed the wire directly into the wellbore to place the wire where it can entangle.

Once the wire is fed into the flow stream and allowed to entangle, a resistance to flow is created in the stream. The more wire that is fed into the wellbore, the greater the resistance to flow, thus creating a Steady Continual Increase in Resistance (SCIR) for reducing the flow leaving the wellbore. This SCIR method is preferred in order to reduce the likelihood of causing damage to the formation, which could lead to fractures and escaping hydrocarbons from the seafloor. Also slowly reducing the flow reduces the chances of damaging the wellbore structure.

DRAWINGS

Figure 1B:
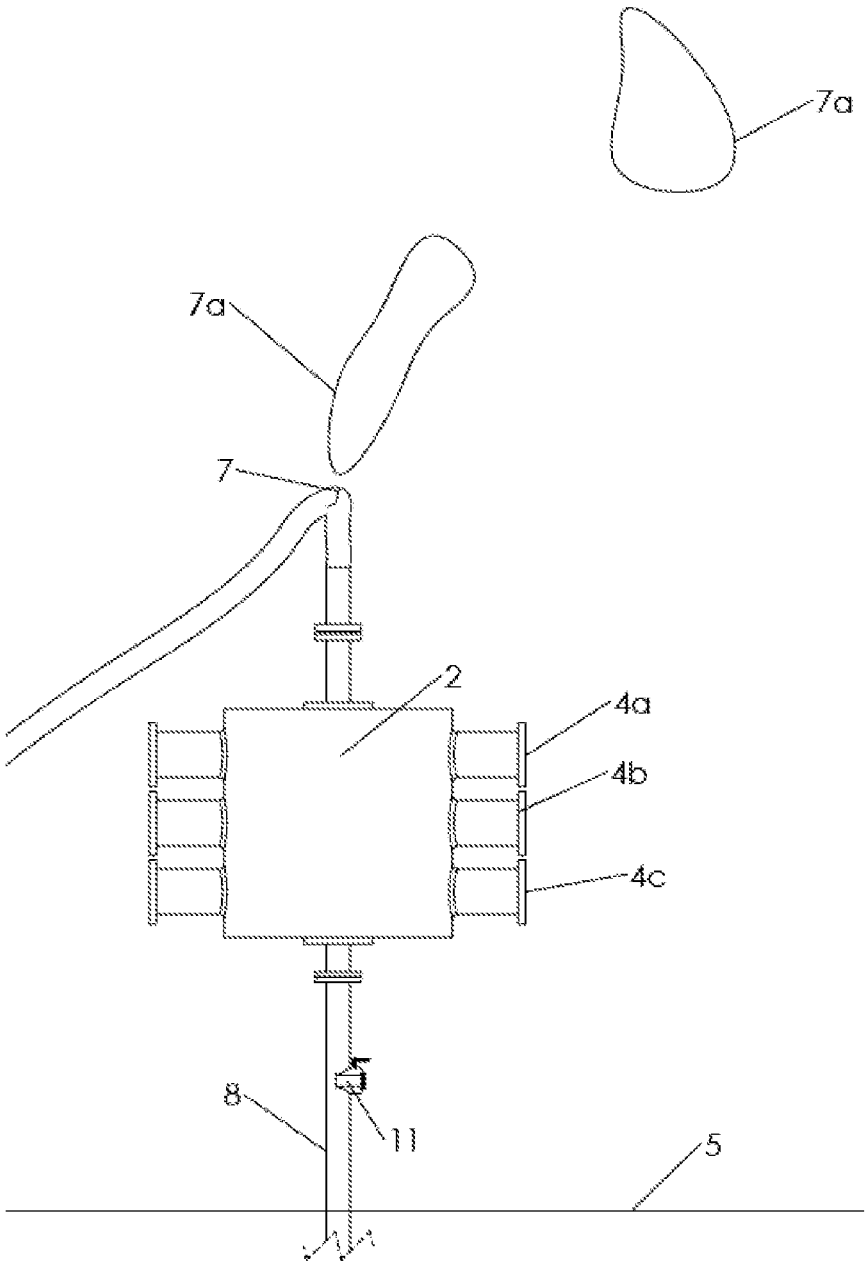

FIG. 1*a* shows an oil platform connected to a blowout preventer on a wellhead on the ocean floor;

FIG. 1*b* shows a catastrophic failure of the system of FIG. 1*a;*

Figure 2A:
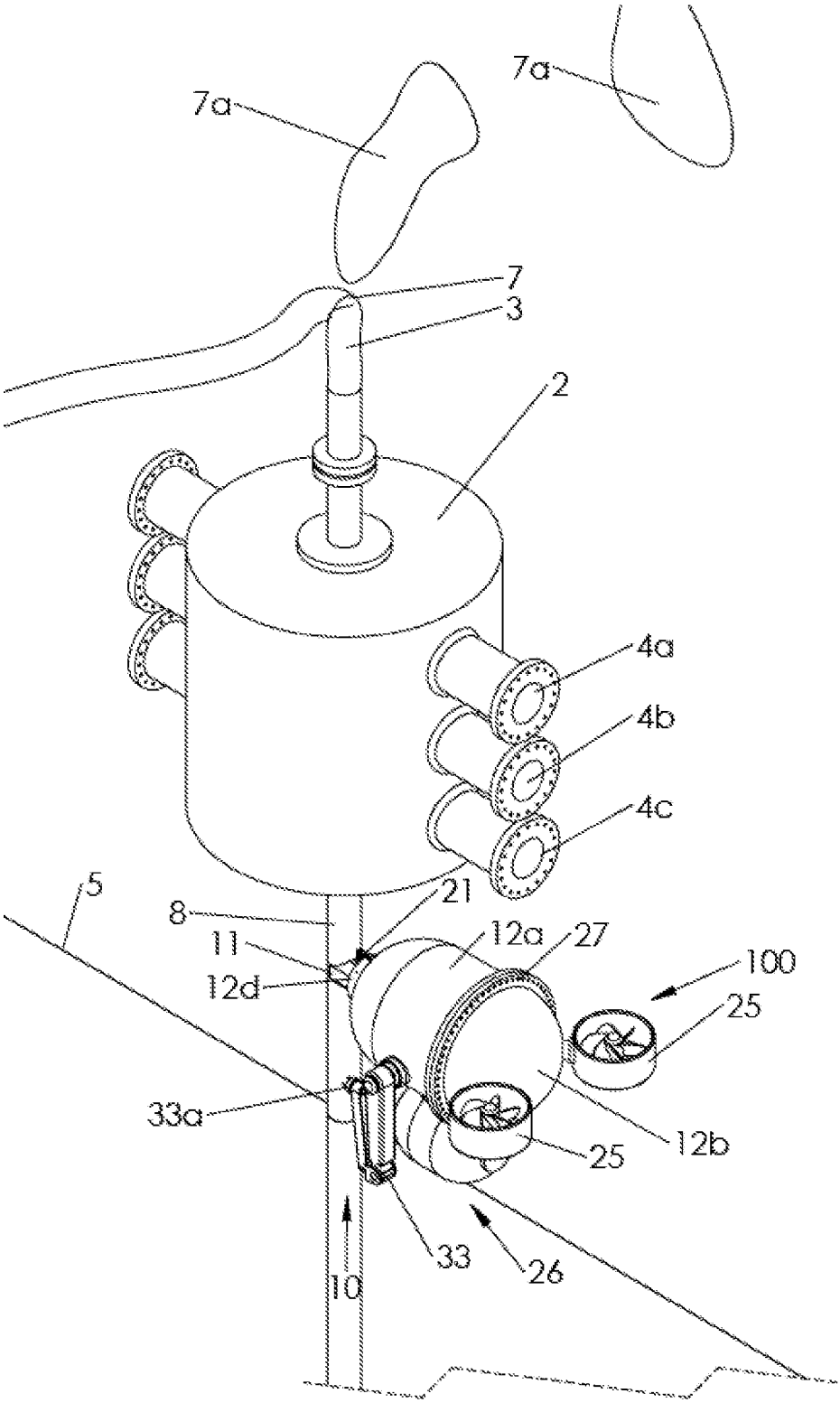
Figure 2B:
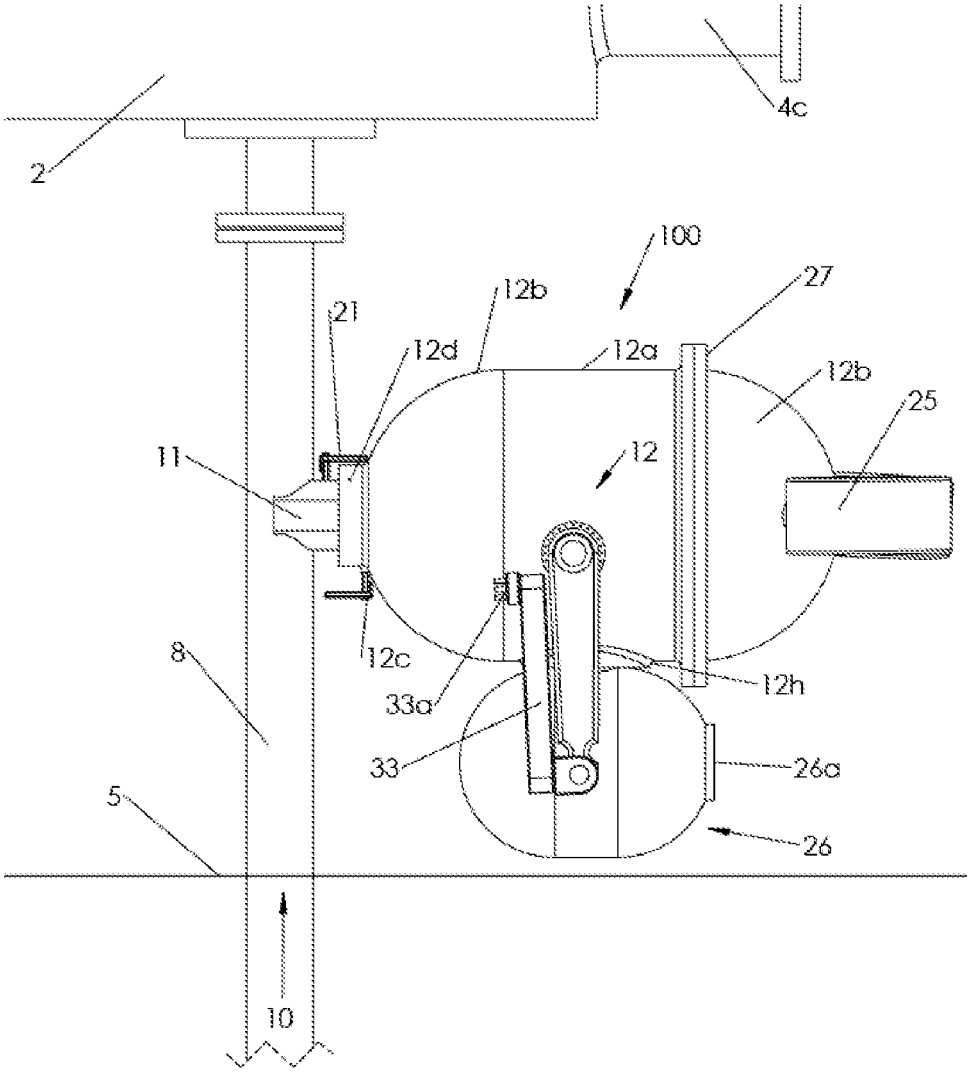

FIG. 2*a* shows a wire feeding device on the casing below the blowout preventer;

FIG. 2*b* shows a close up side view of FIG. 2*a;*

Figure 2C:
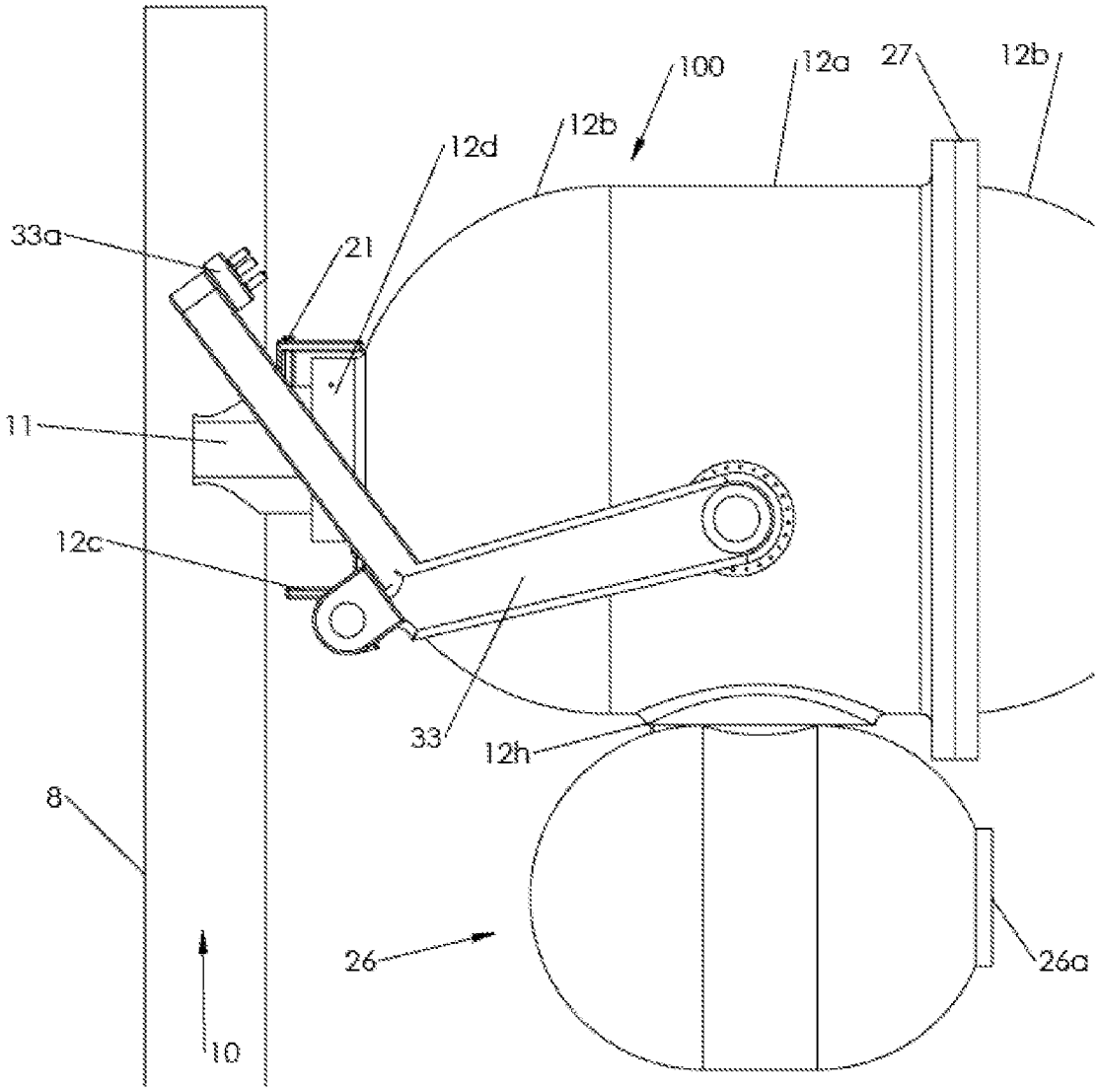
Figure 2D:
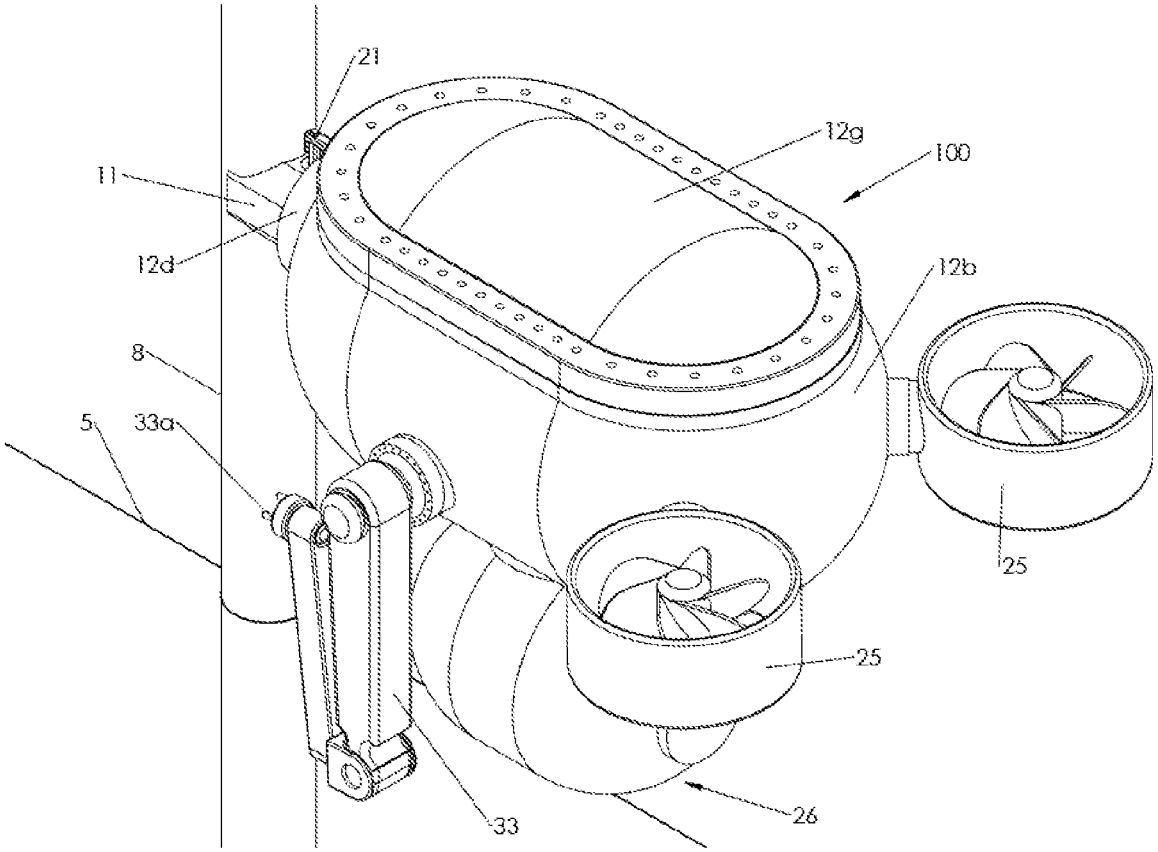
Figure 3A:
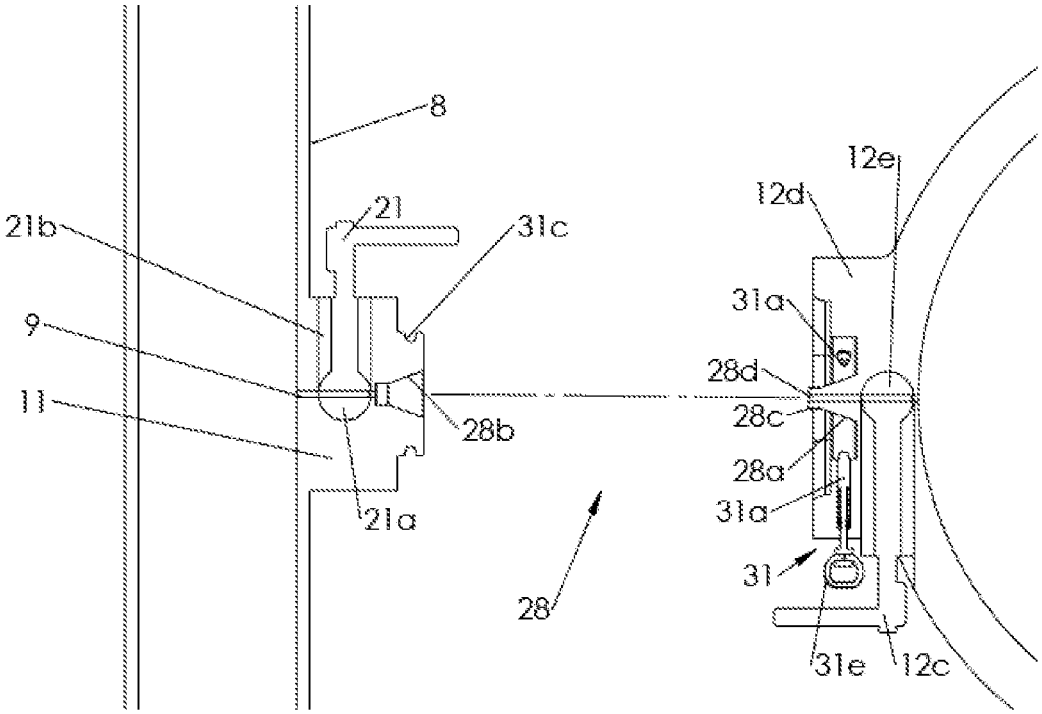
Figure 3B:
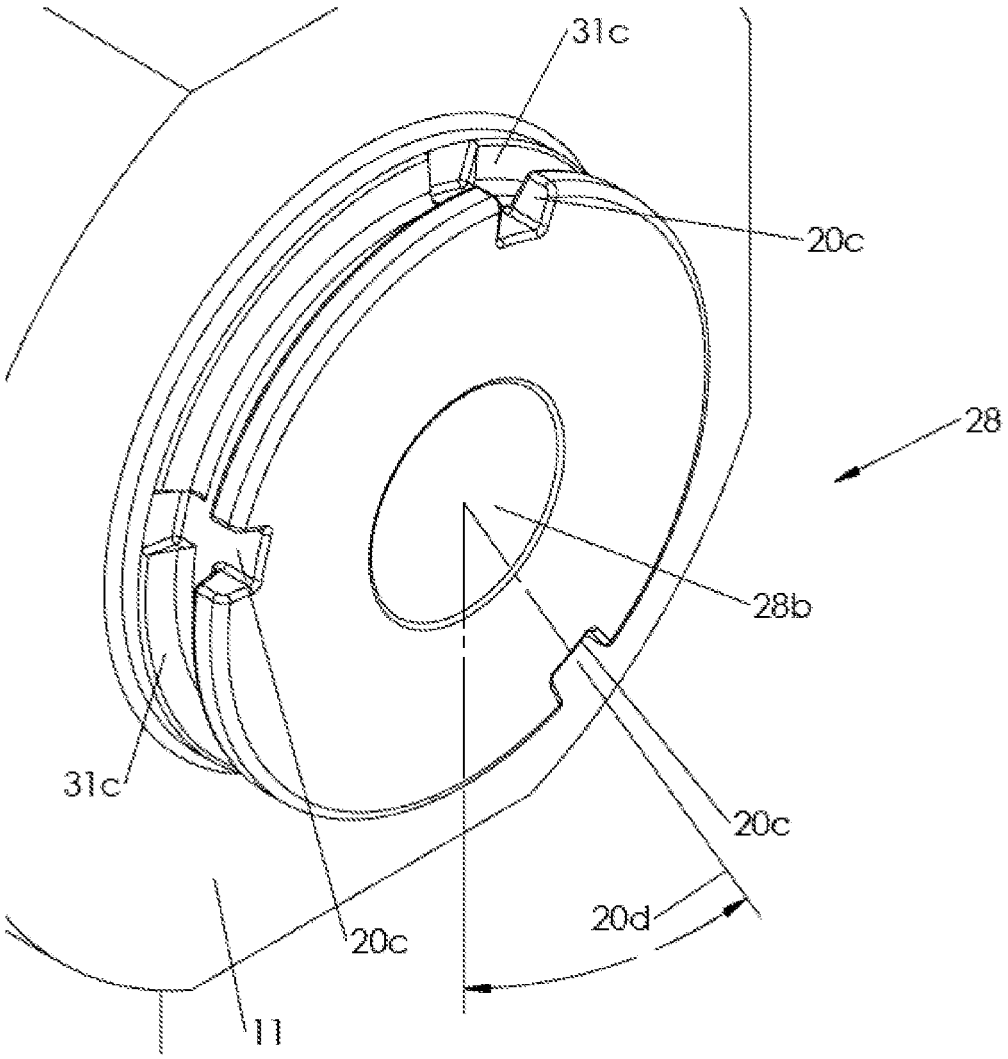
Figure 3C:
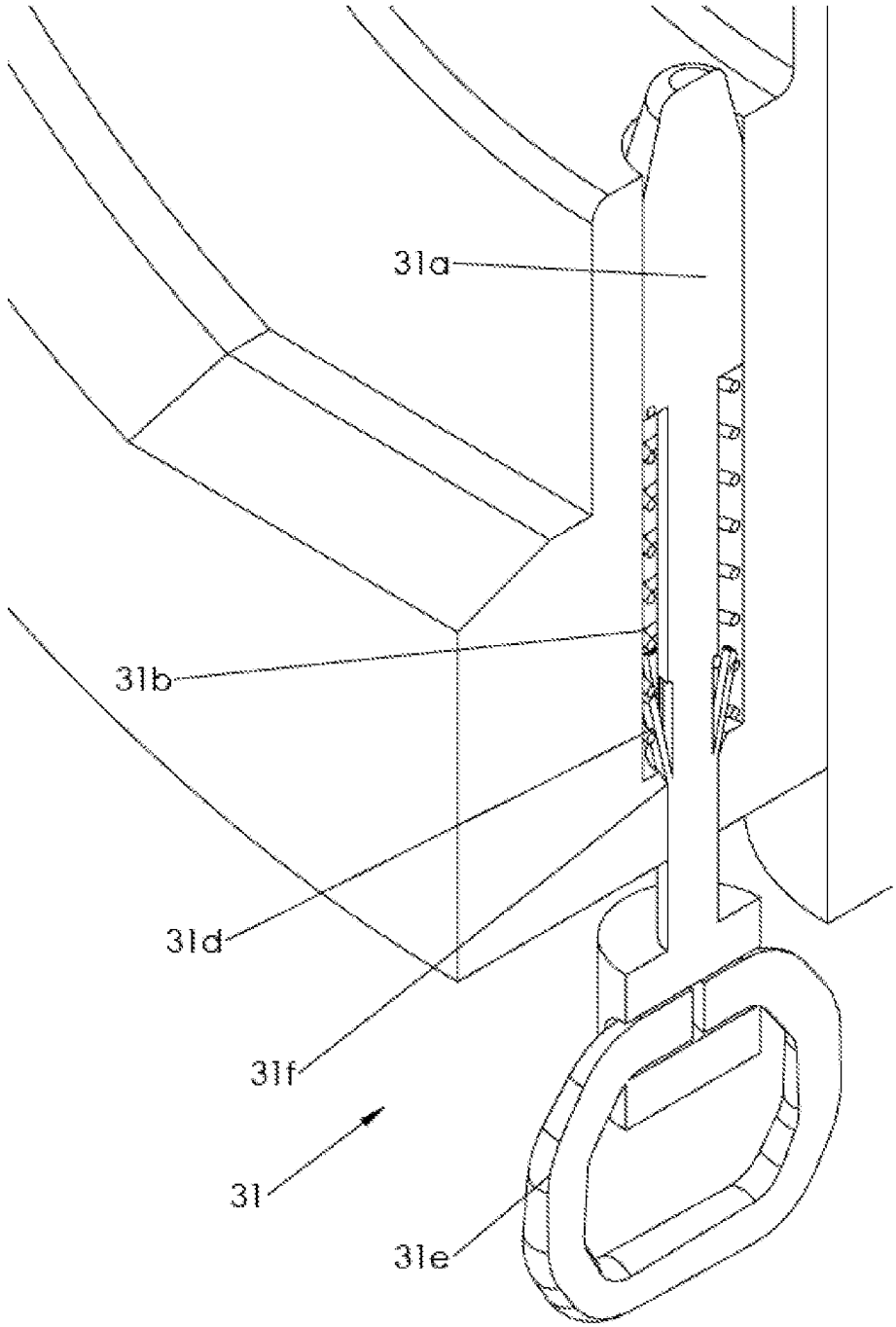
Figure 3D:
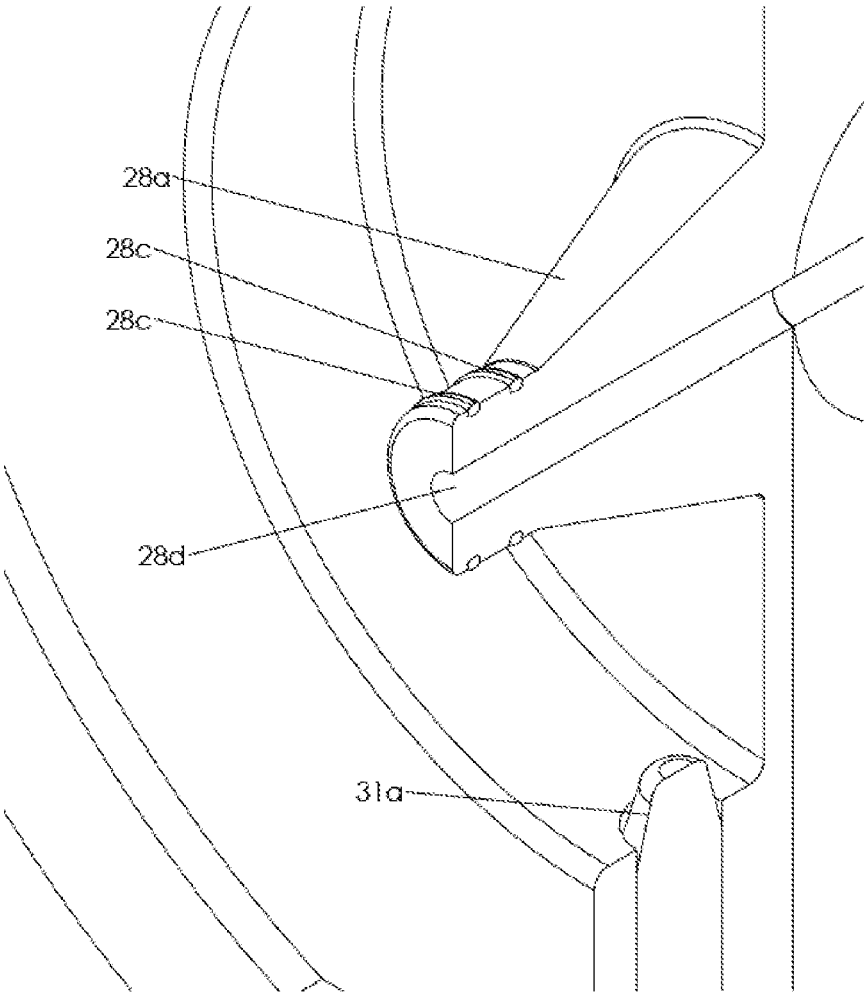
Figure 4A:
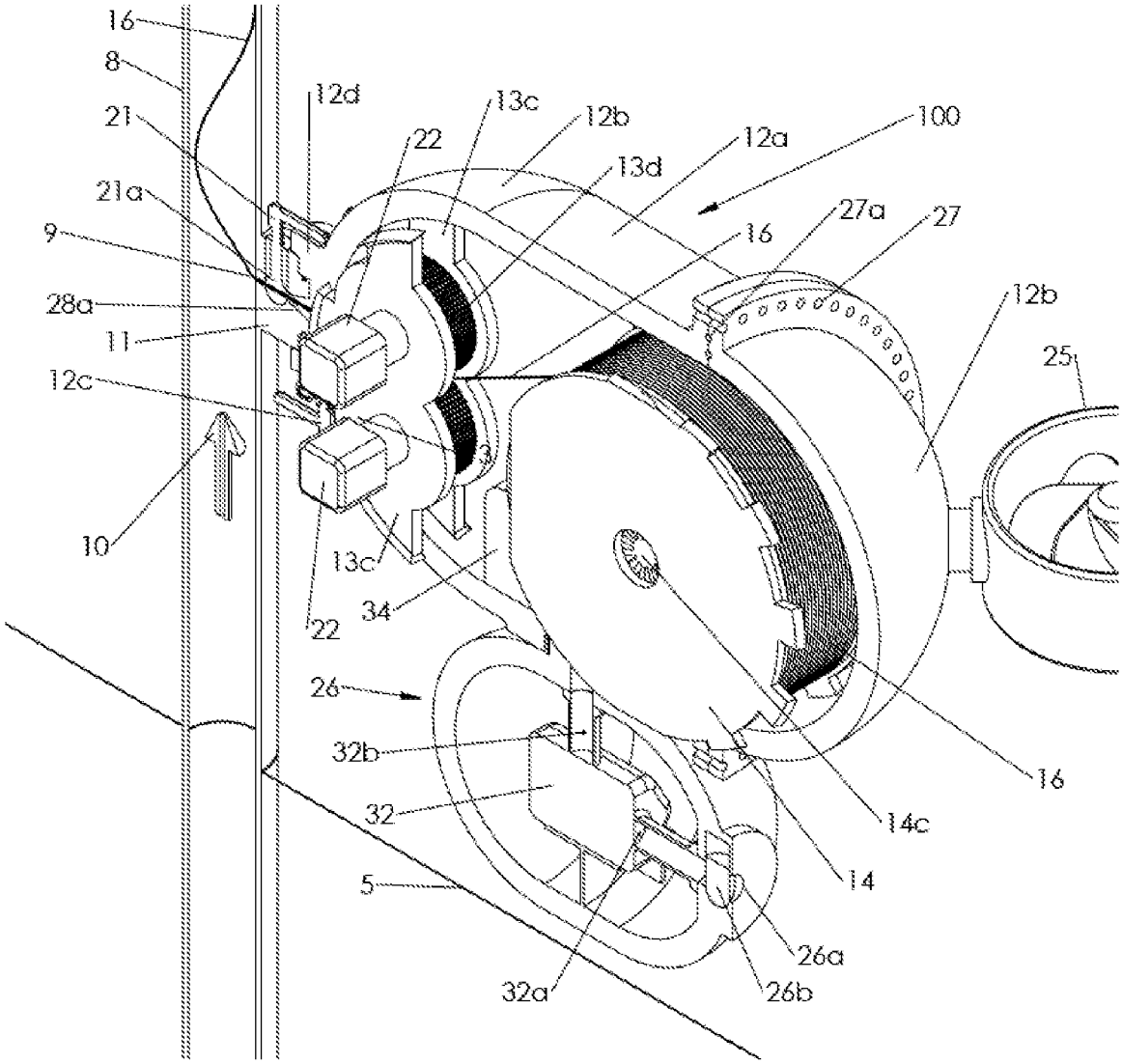
Figure 4B:
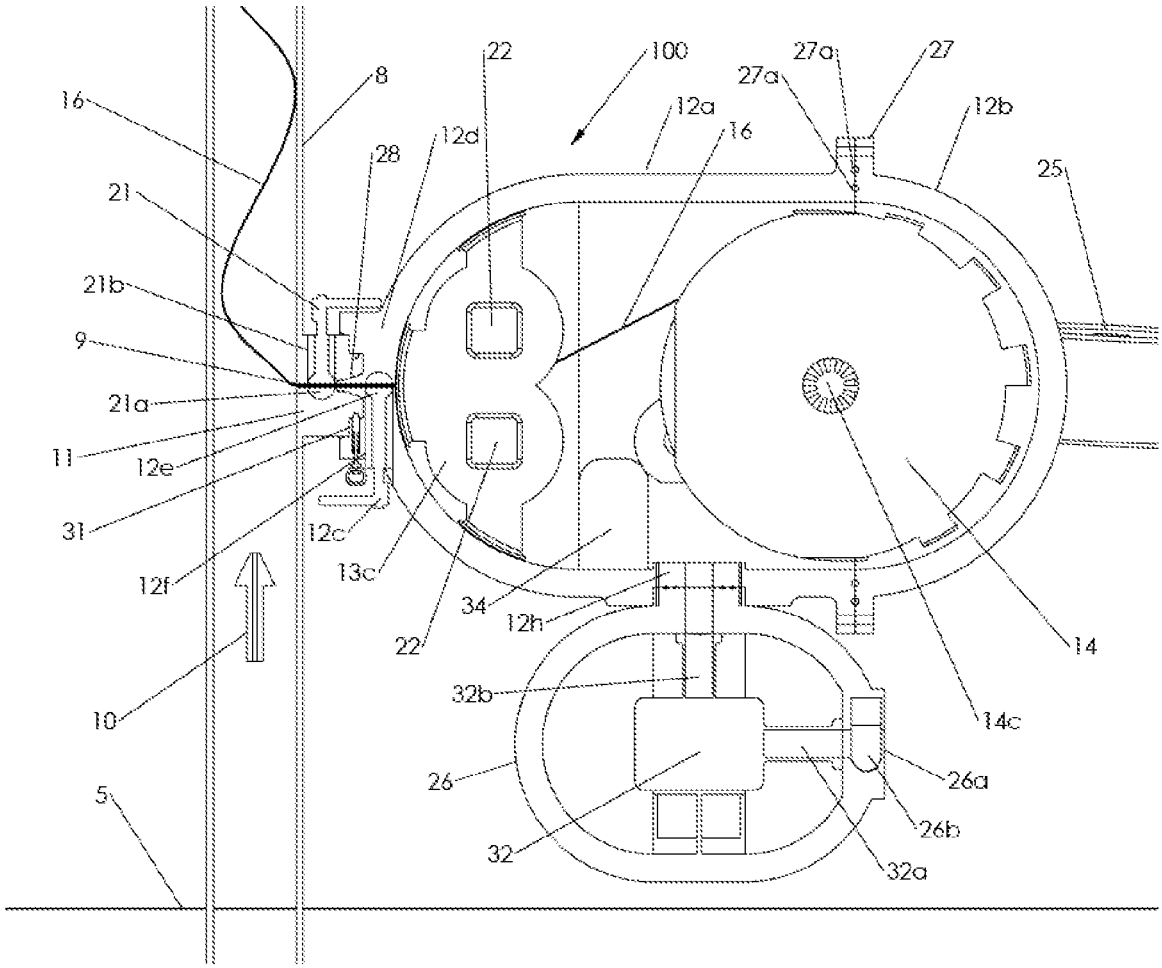

FIG. 2*c* shows the feeding machine using an arm to open the feeding valve;

FIG. 2*d* shows an alternative pressure vessel design for the wire feeding machine;

FIG. 3*a* is a close up view of the connection between the machine and a feeding valve (port) on the casing;

FIG. 3*b* is a close up view of the casing access port;

FIG. 3*c* is a close up view of the locking mechanism that secures the machine to the casing access port;

FIG. 3*d* is a close up cross section view of the male portion of the alignment cone;

FIG. 4*a* is a cross section of housing and pressurizing unit exposing the interiors of the feeding machine;

FIG. 4*b* shows a side view of FIG. 4*a;*

Figure 5:
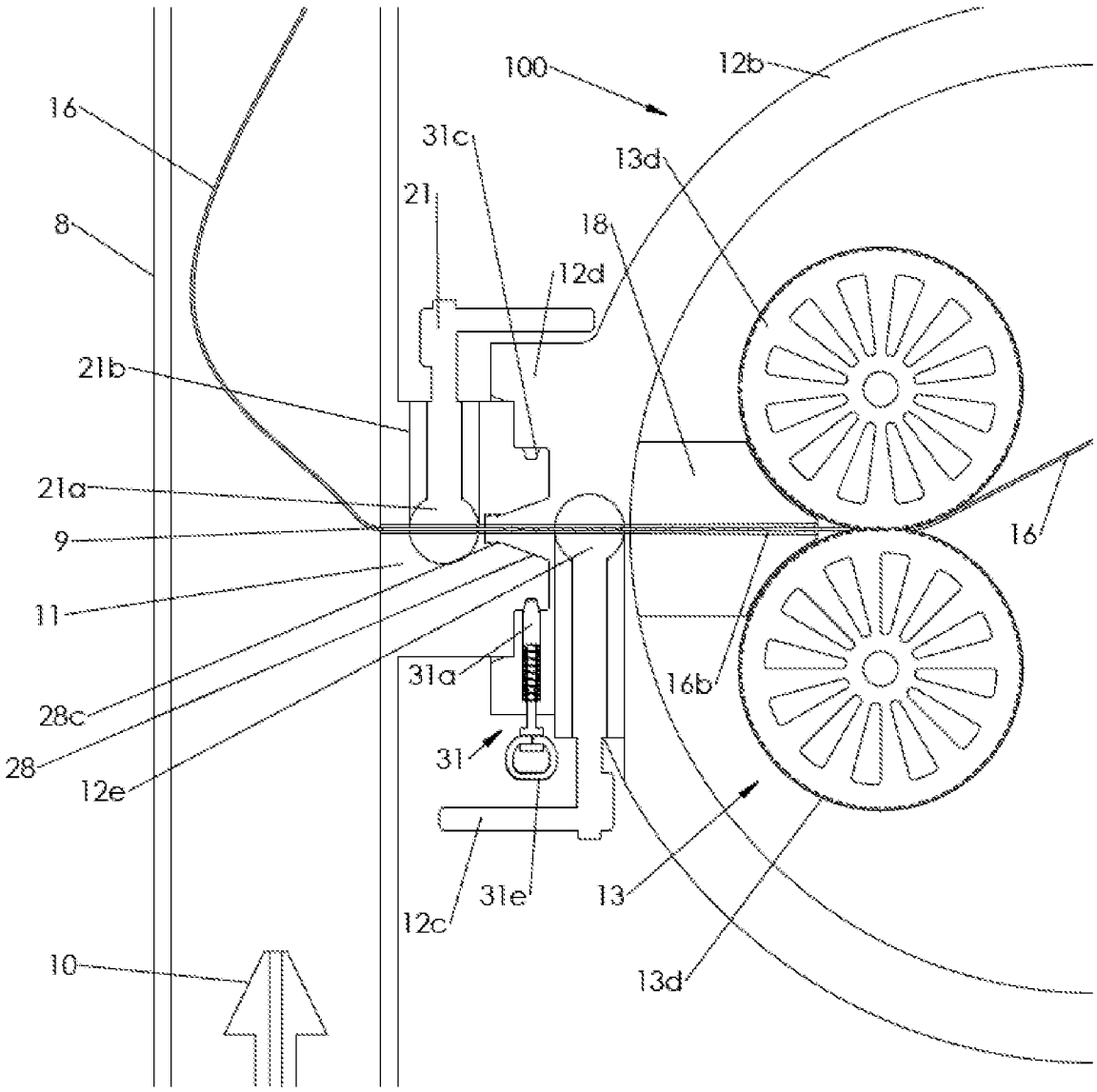
Figure 6A:
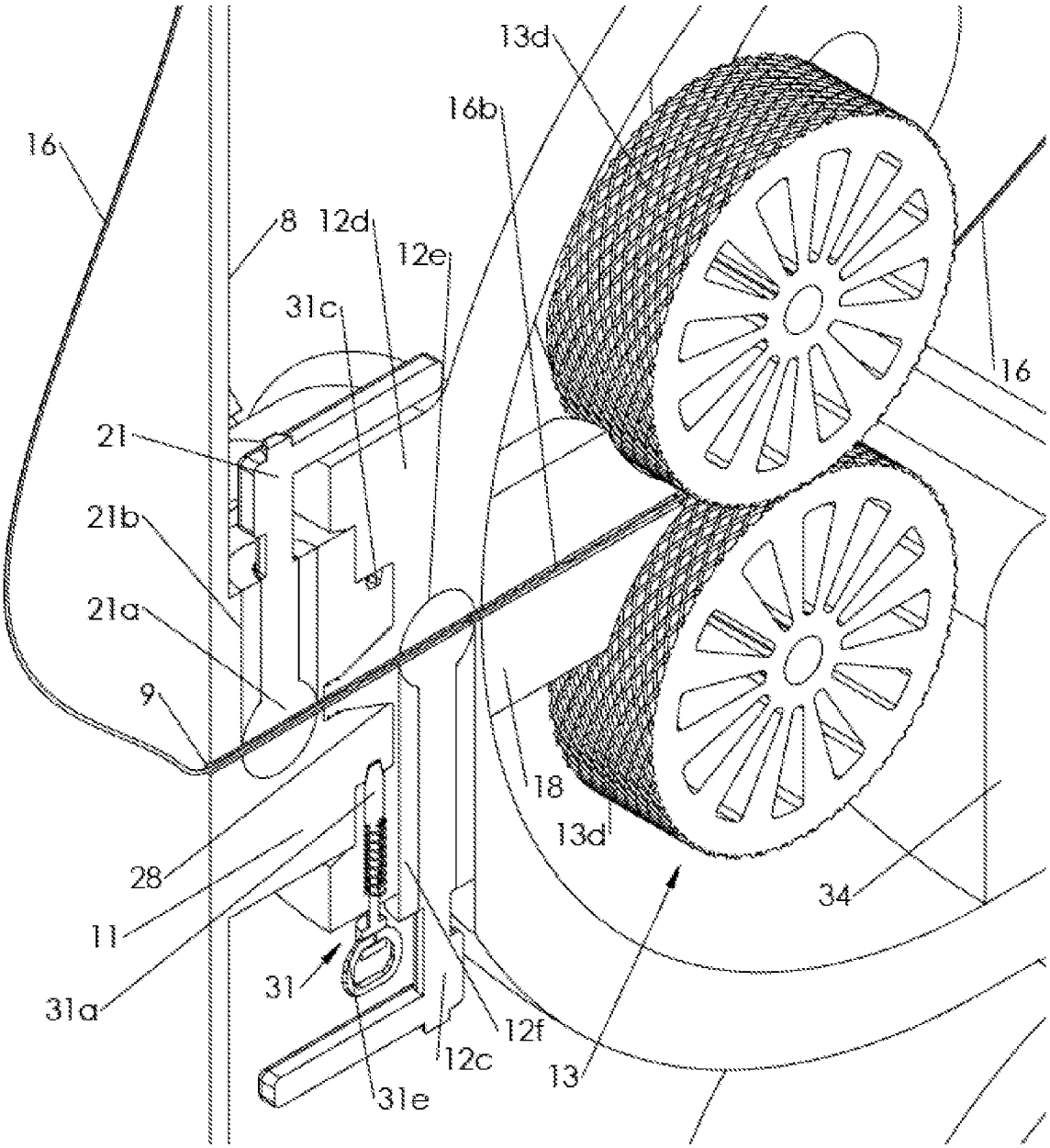

FIG. 5 close up view of the feeding mechanism and valves;

FIG. 6*a* close up view of knurling driving wheels deforming the wire

Figure 6B:
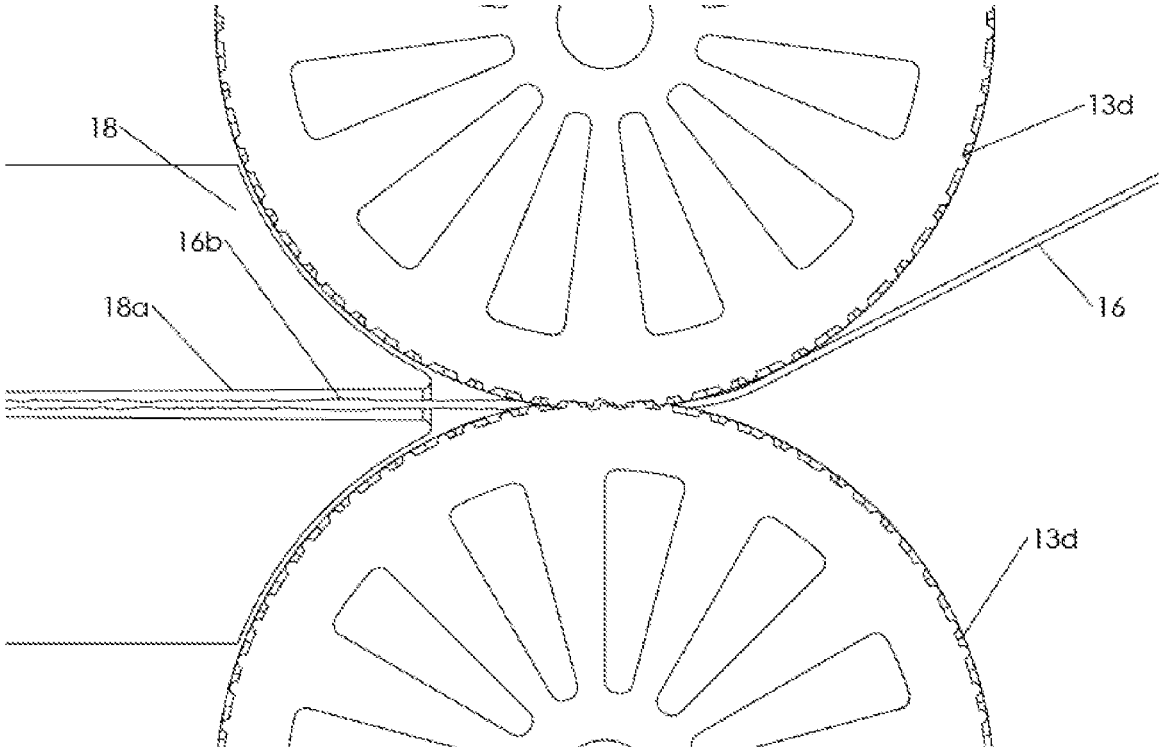
Figure 6C:
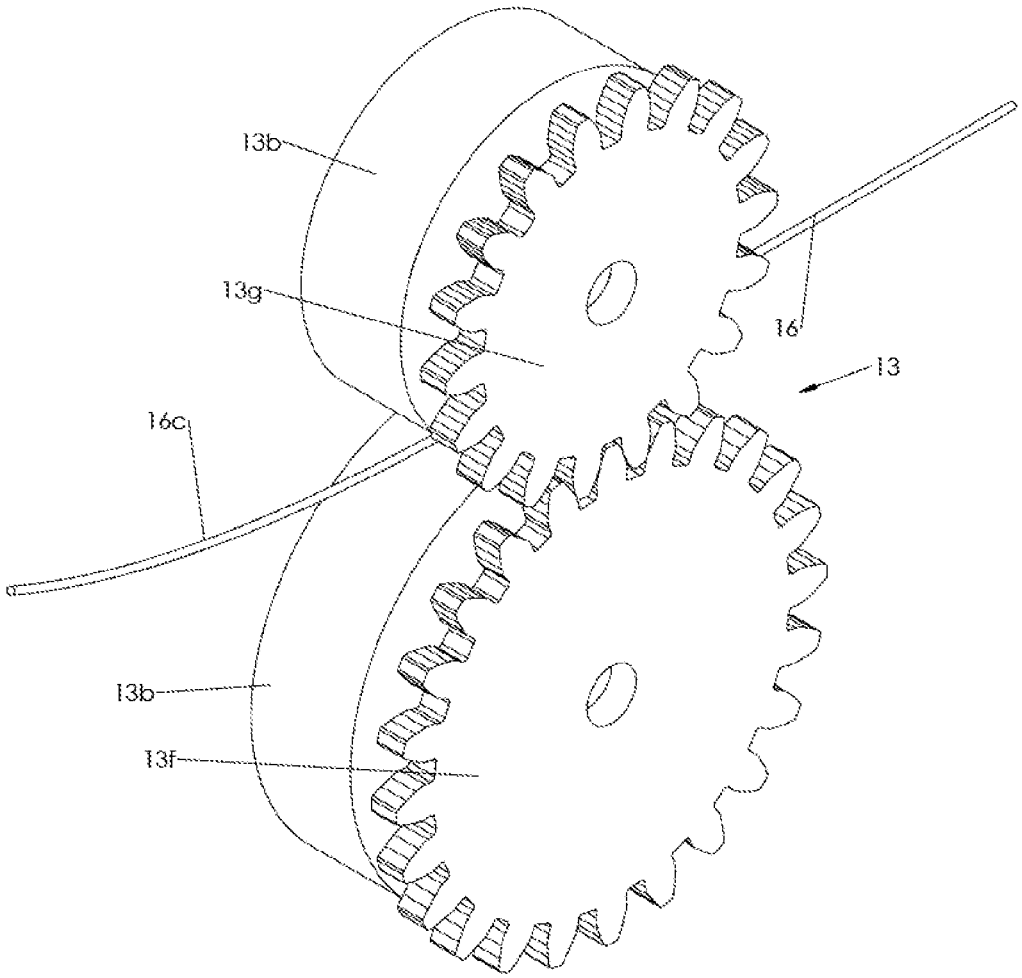
Figure 7:
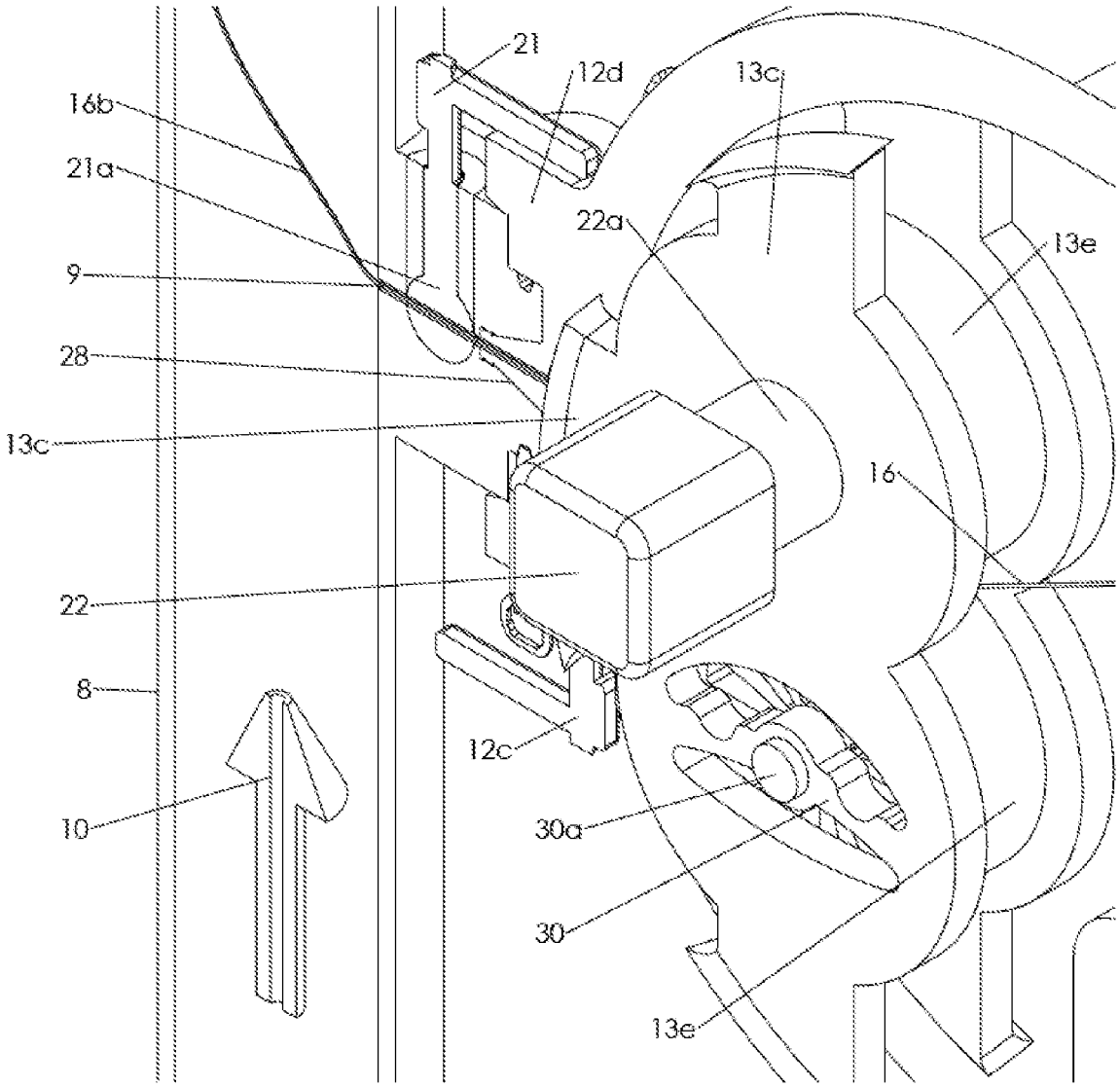
Figure 8A:
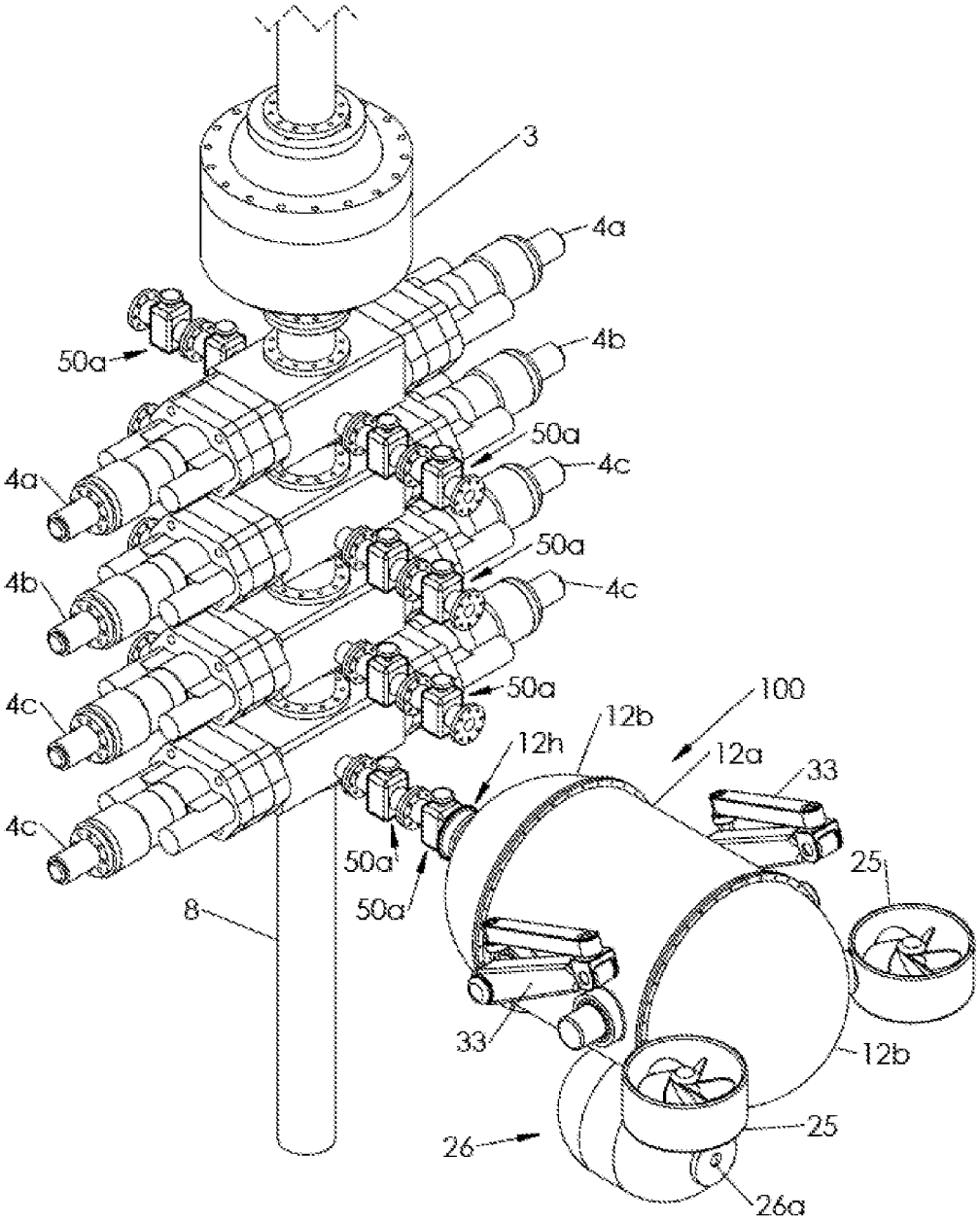
Figure 8B:
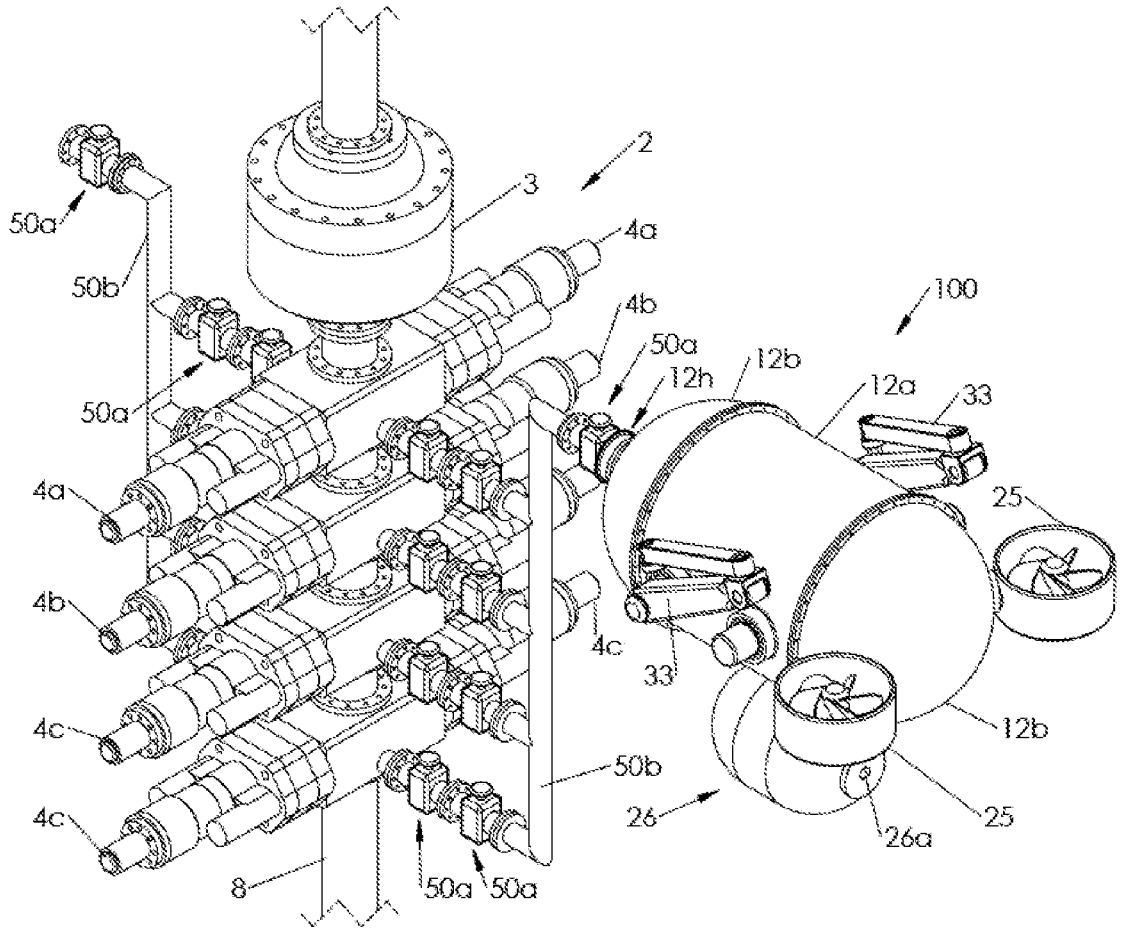
Figure 8C:
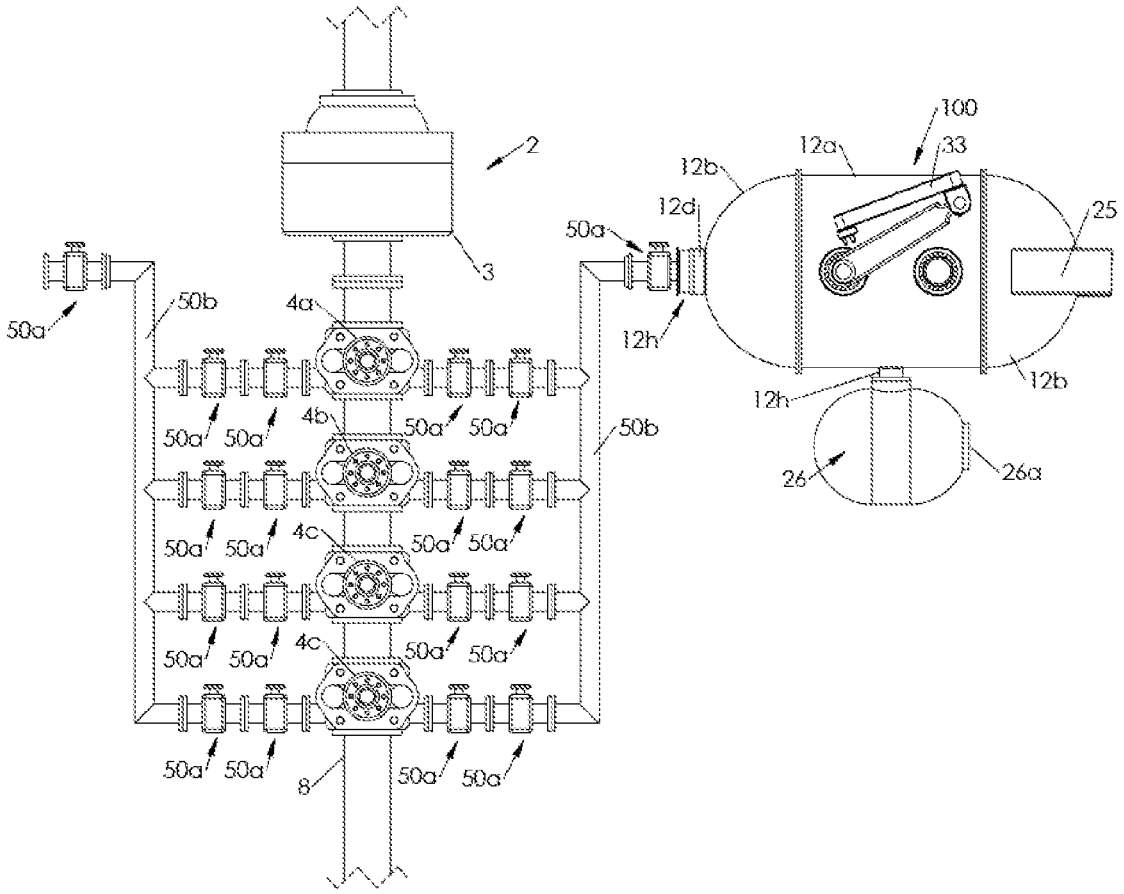
Figure 9A:
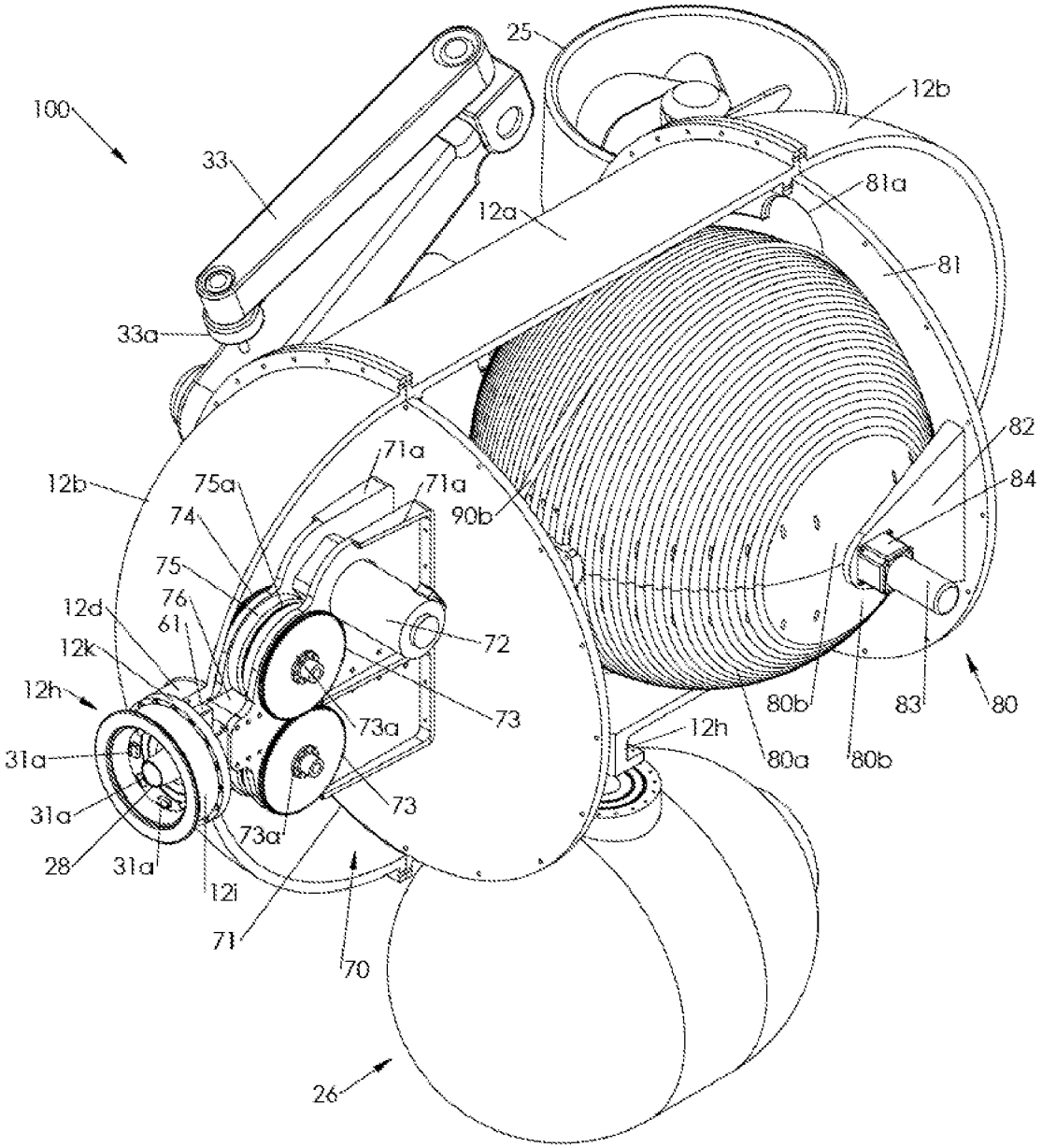
Figure 9B:
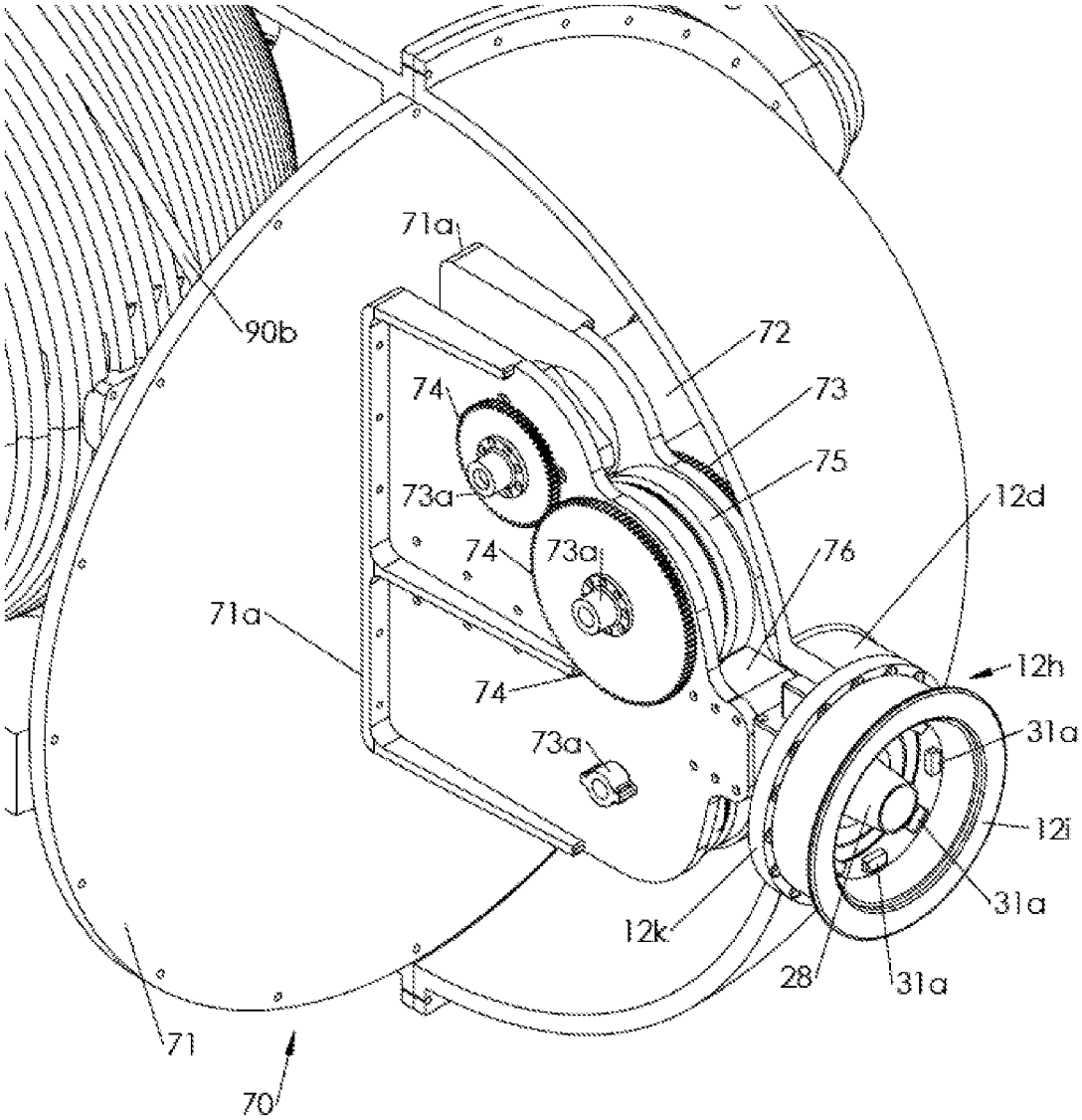
Figure 9C:
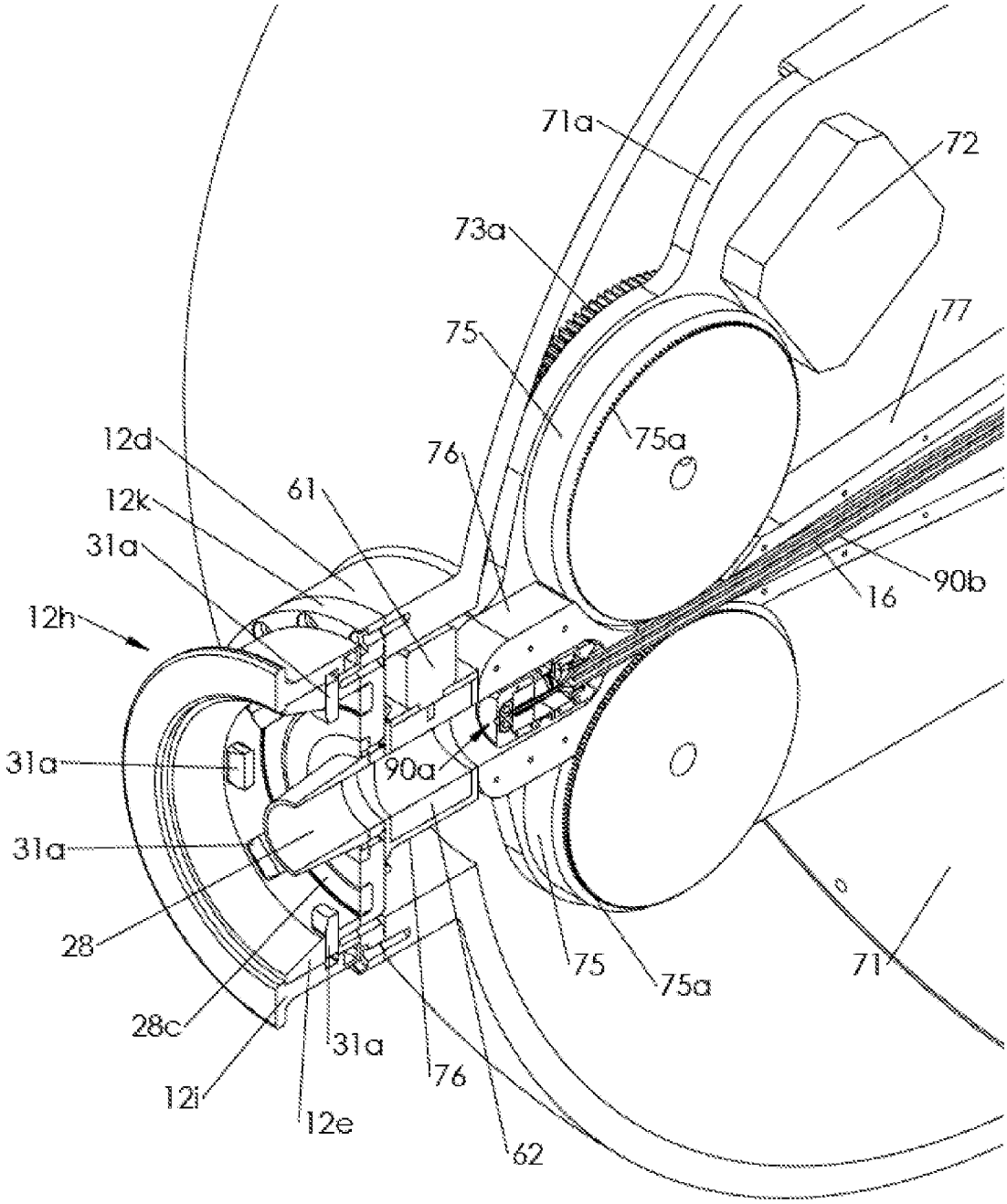
Figure 9D:
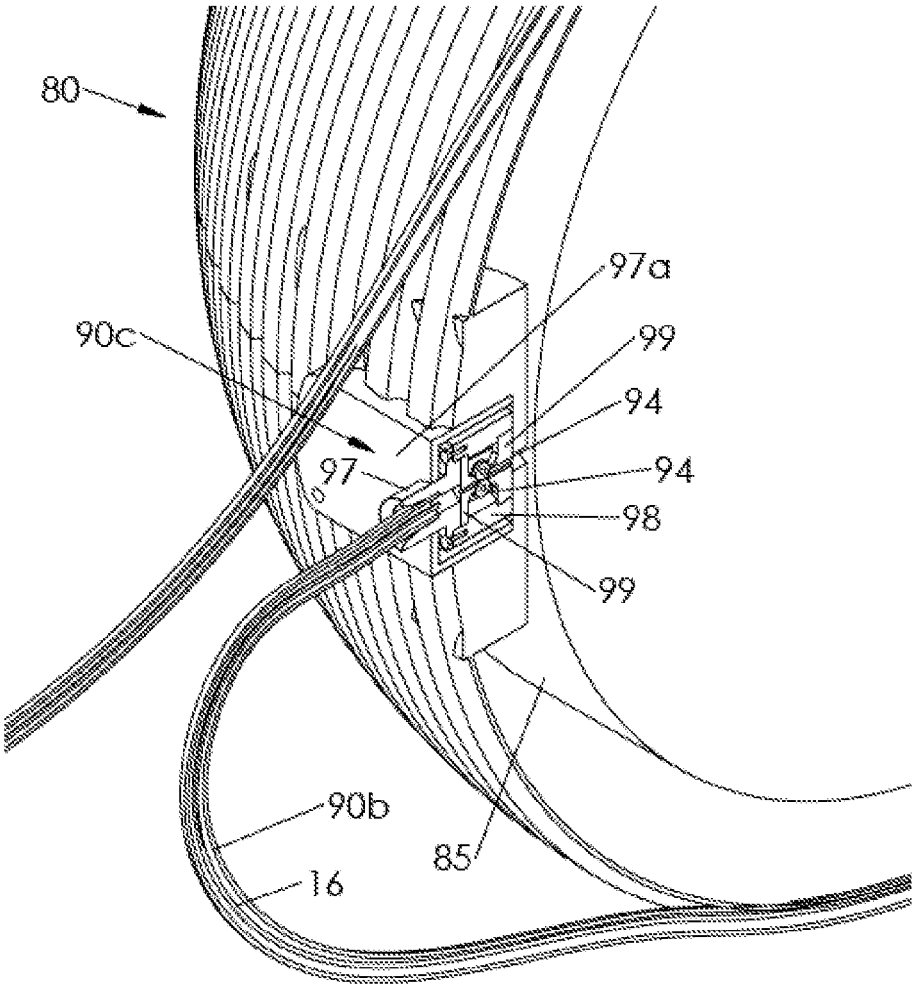
Figure 9E:
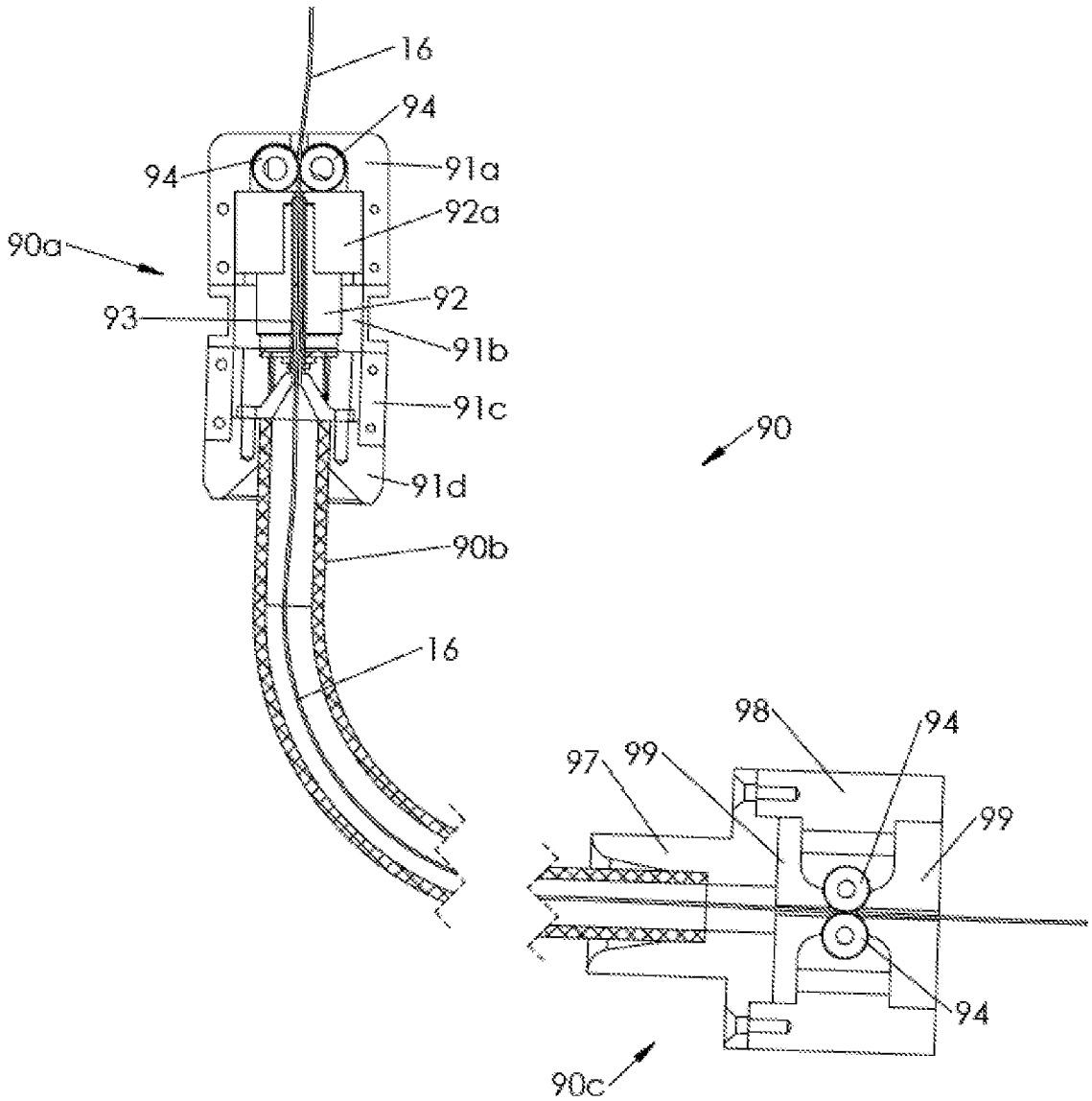
Figure 9F:
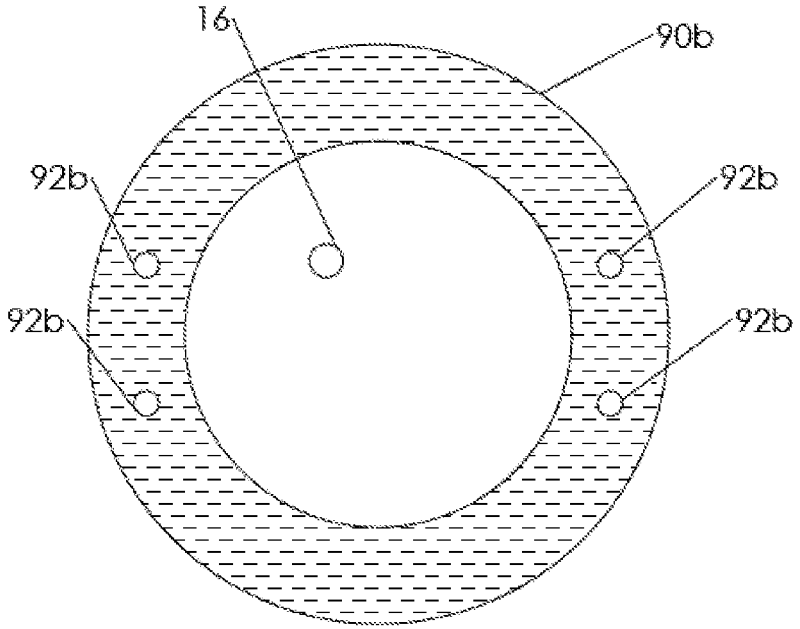
Figure 9G:
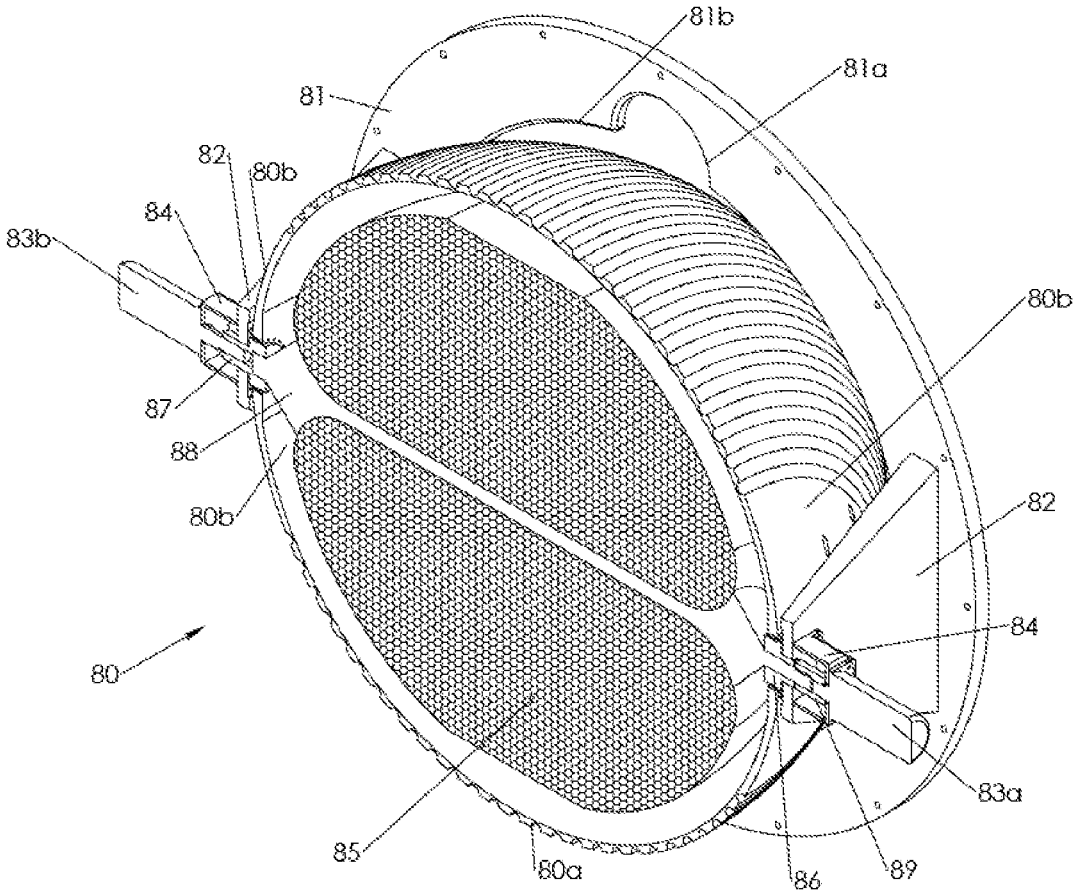
Figure 10A:
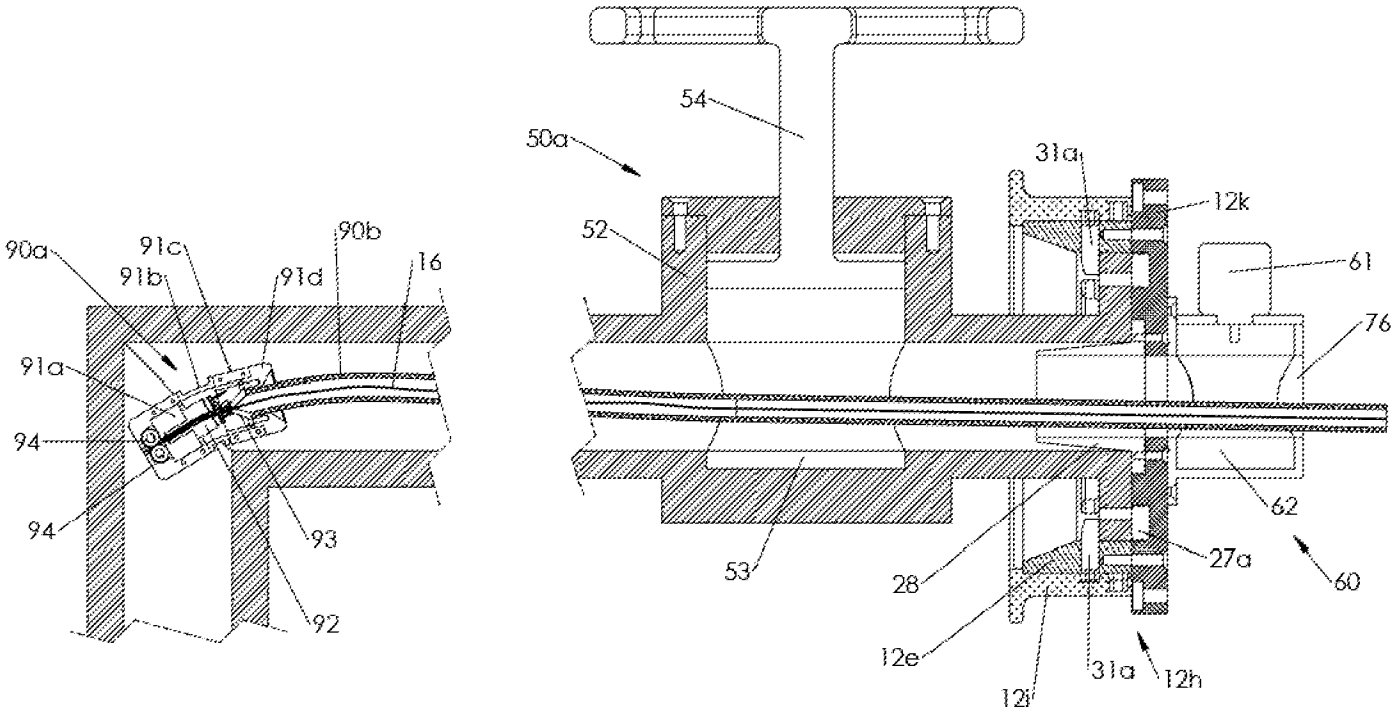
Figure 10B:
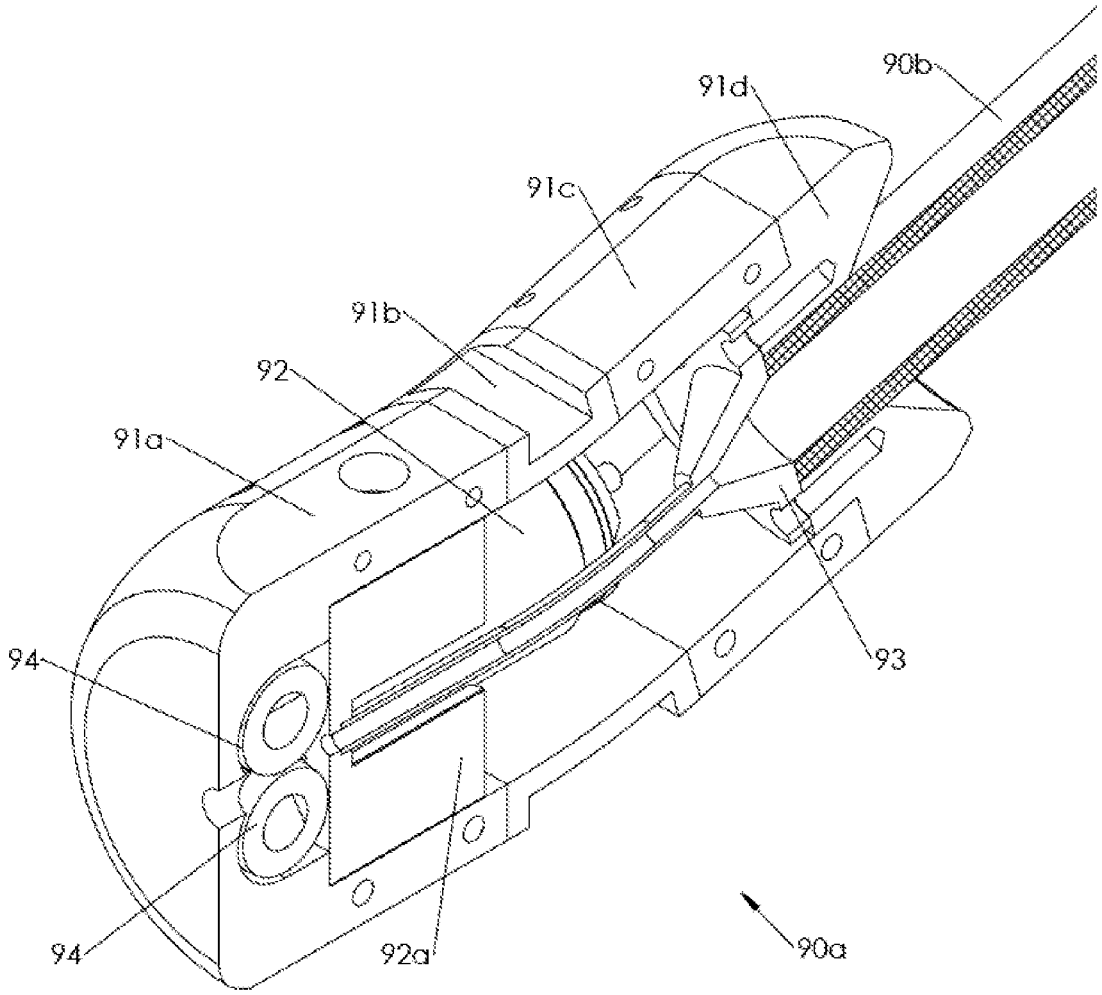
Figure 10C:
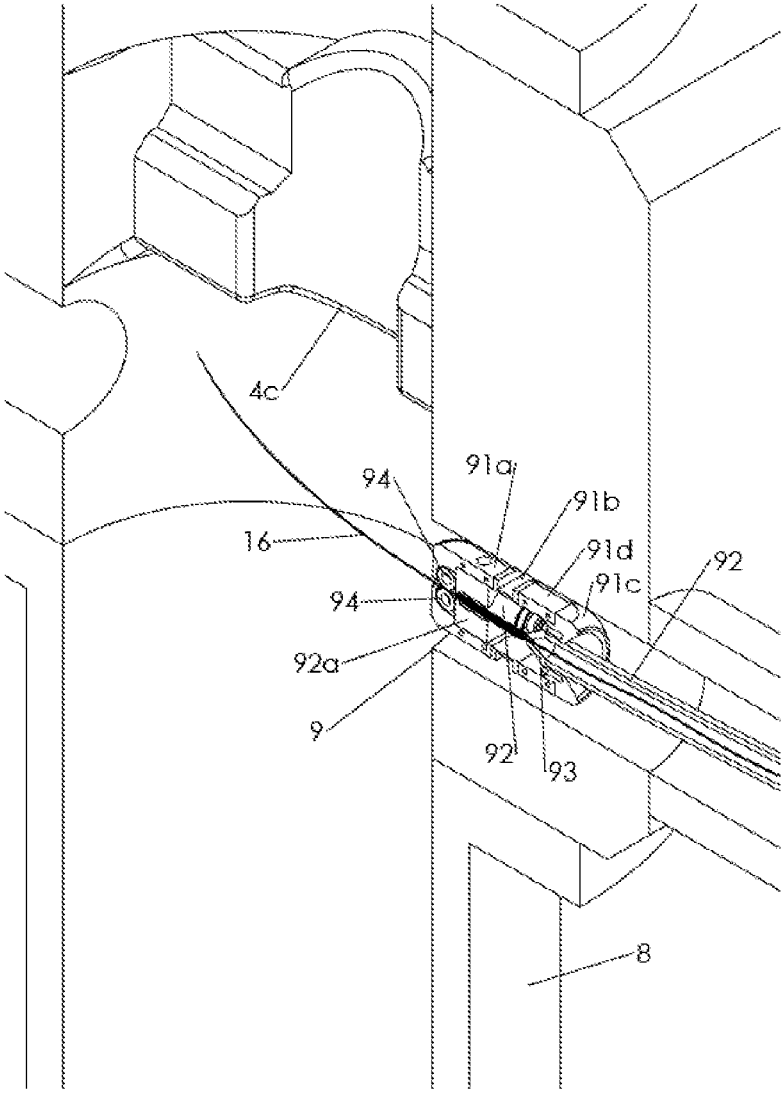
Figure 10D:
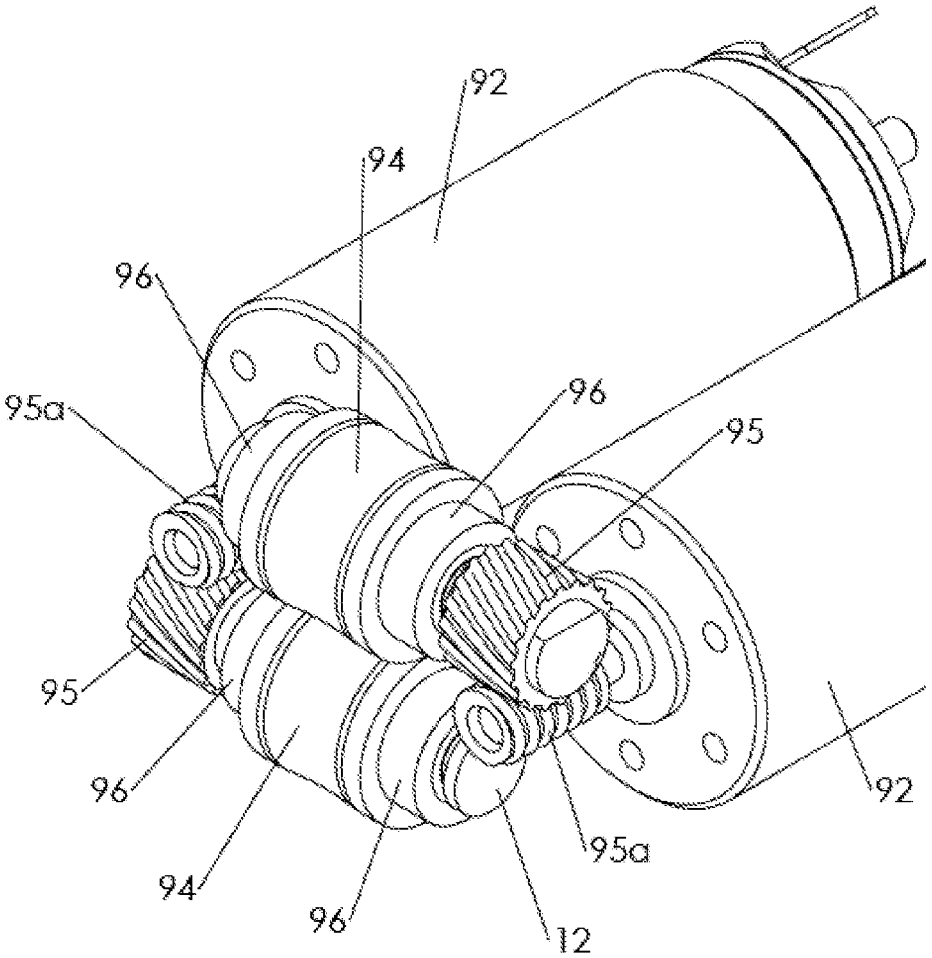
Figure 11D:
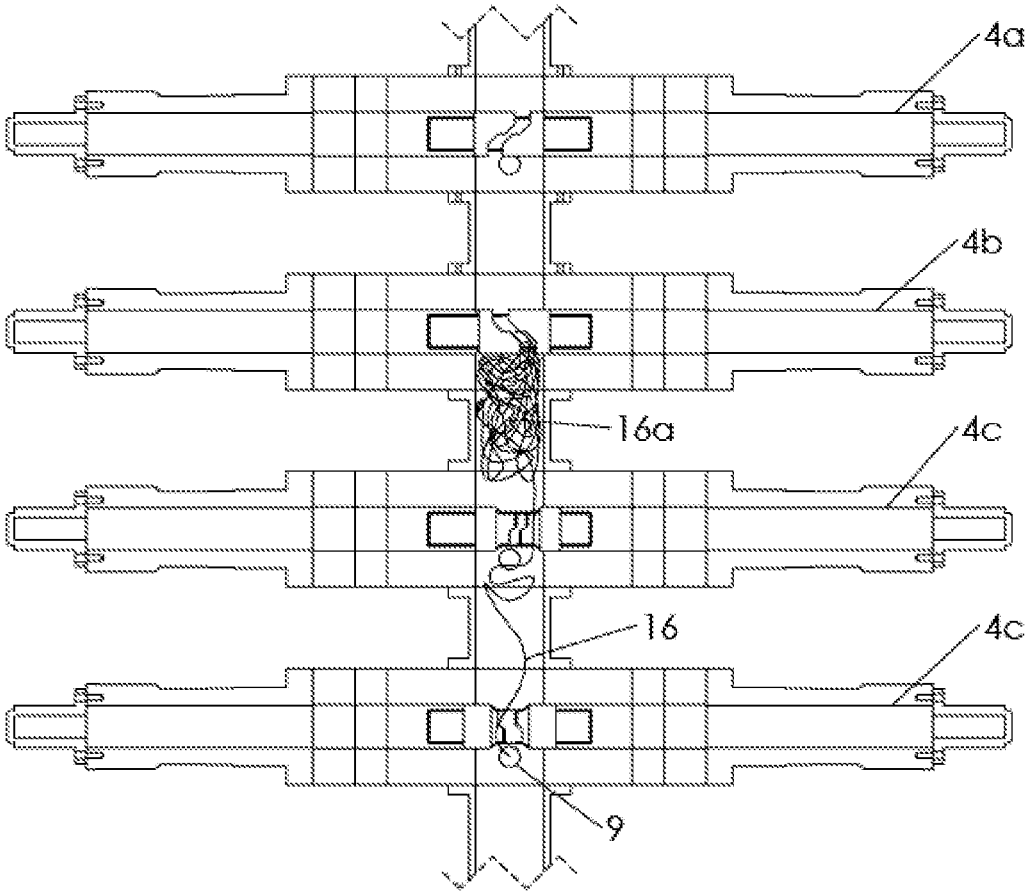
Figure 12A:
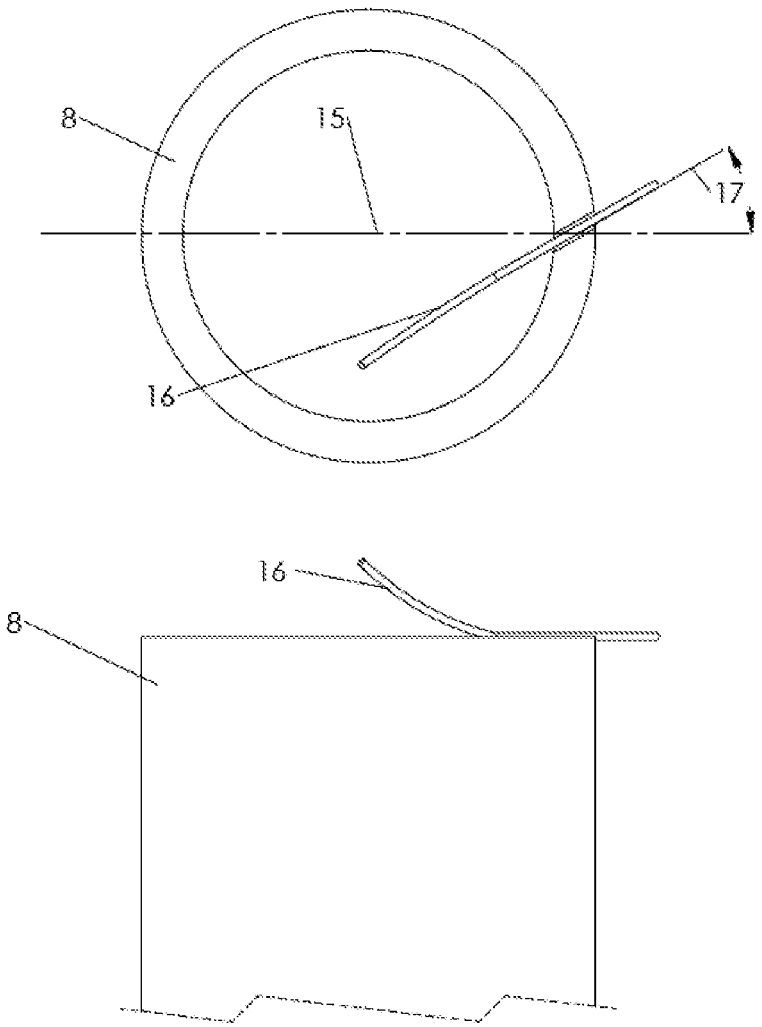
Figure 12B:
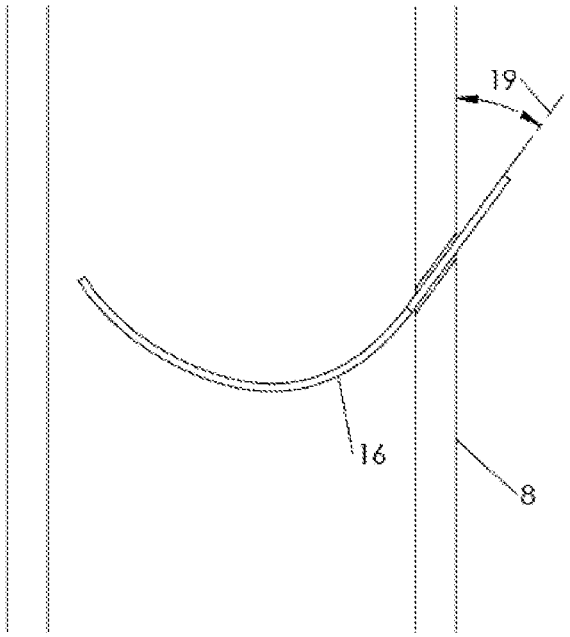
Figure 13:
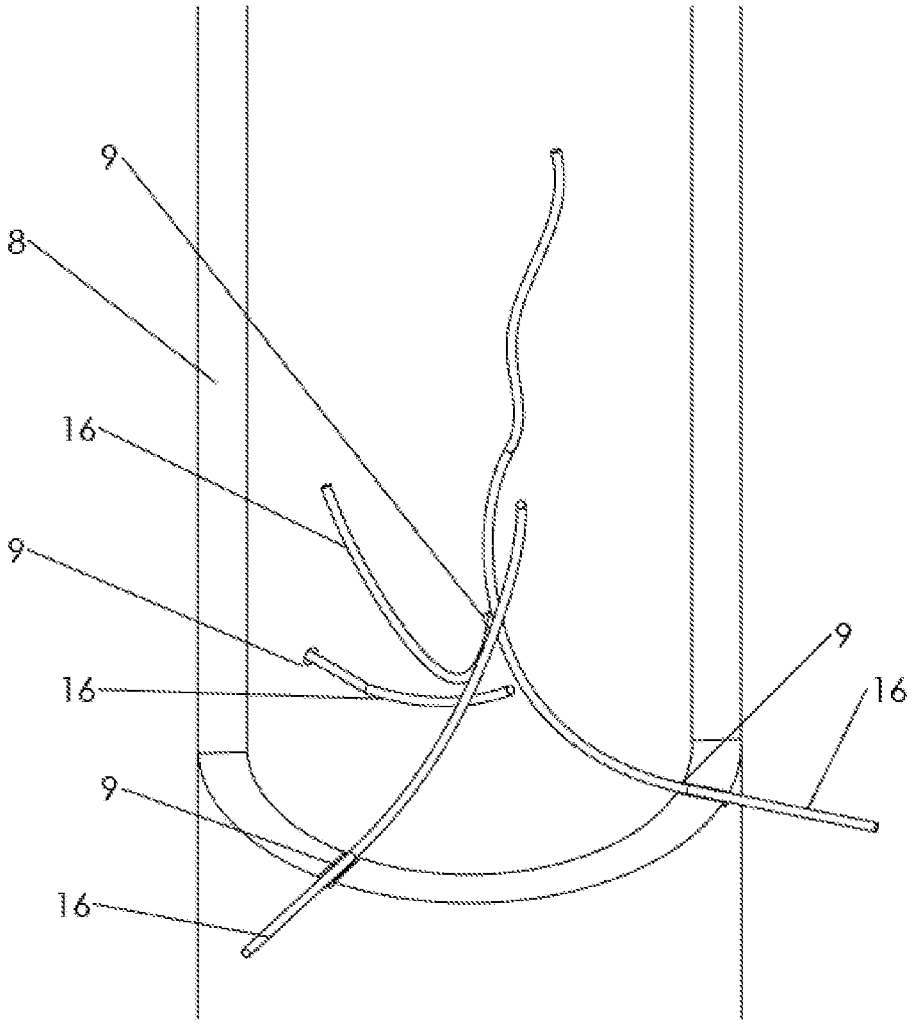
Figure 14A:
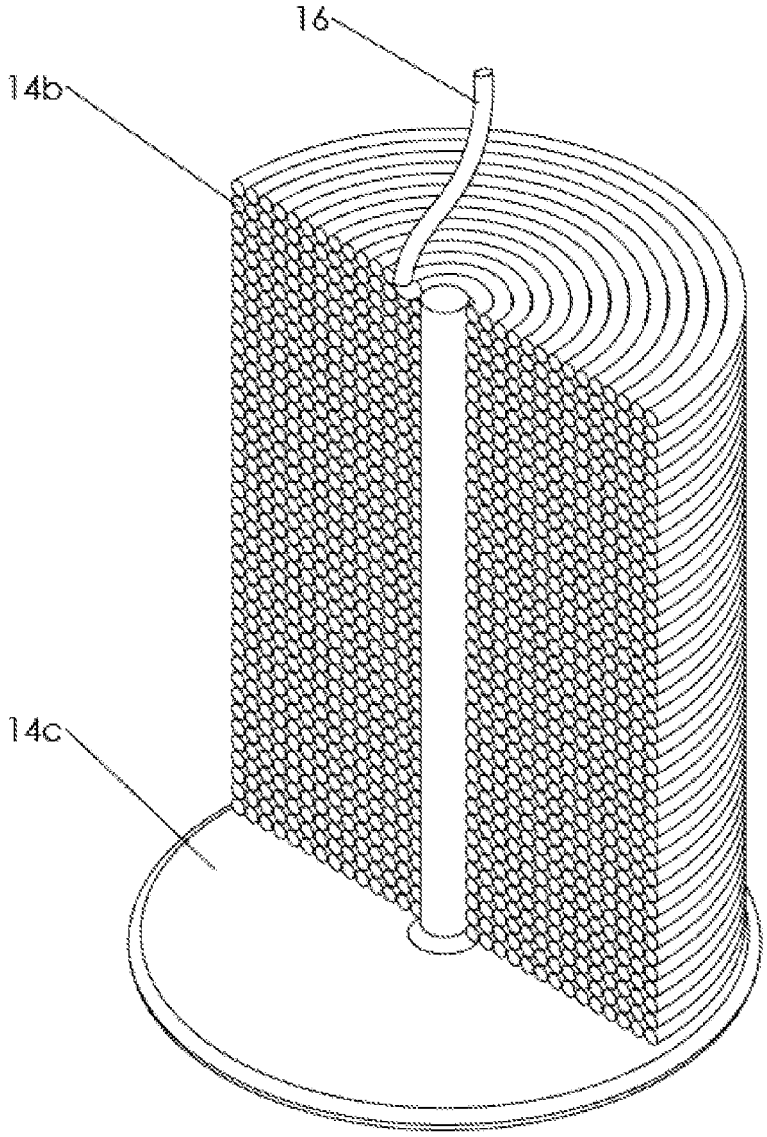
Figure 14B:
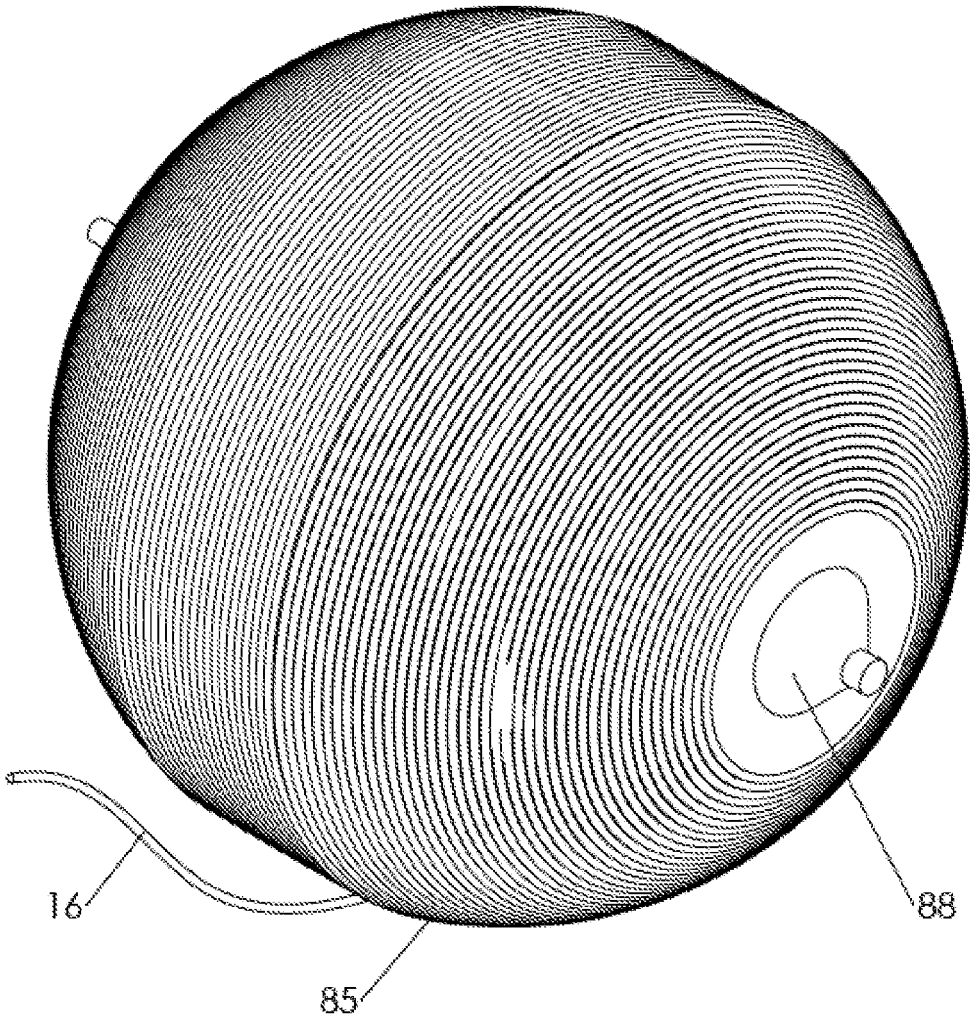

FIG. 6*b* illustrates how the drive rollers can impart features into the wire to aid in entanglement in the wellbore;

FIG. 6*c* illustrates how the drive rollers can impart curvature into the wire to aid in entanglement in the wellbore;

FIG. 7 illustrates the use of a flexure to impart a gripping force on the wire during the feeding process;

FIG. 8*a* shows the feeding machine connecting to a straight choke/kill line port on a BOP via an access valve where a proboscis is used deliver the wire into the wellbore;

FIG. 8*b* shows the feeding machine connecting to a meandering choke/kill line port via an access valve where a proboscis is used to deliver the wire into the wellbore;

FIG. 8*c* is a side view of the feeding machine connected to the meandering travel path for the proboscis;

FIG. 9*a* is a cross section of the casing module exposing the interiors of the feeding machine with a proboscis drive system;

FIG. 9*b* close up of the drive system for the proboscis drive system;

FIG. 9*c* is a cross section of the valve module and proboscis feeder module;

FIG. 9*d* is a cross section of the proboscis tail and spindle module interface;

FIG. 9*e* is an isolated cross section of the proboscis: head, body, and tail;

FIG. 9*f* is a cross section of the proboscis body;

FIG. 9*g* is a cross section view of the spindle module drive system;

FIG. 10*a* is a cross section of the proboscis head navigating around a 90 degree bend;

FIG. 10*b* is a cross section of the proboscis head;

FIG. 10*c* is a cross section of the proboscis head at the wellbore port interface;

FIG. 10*d* is a close up view of the wire drive mechanism at the head of the proboscis;

FIG. 11*a* shows wire fed into the wellbore and being taken by the flow stream;

FIG. 11*b* shows wire fed into the wellbore generating entanglement resembling an infinity (sideways 8) symbol;

FIG. 11*c* shows wire fed into the wellbore generating entanglement that is a chaotic short buckling wavelength entanglement;

FIG. 11*d* shows the wire entanglement anchoring on partially deployed RAMs downstream of the wire insertion;

FIG. 12*a* shows a non-orthogonal (chord) feeding orientation of the wire into the wellbore;

FIG. 12*b* shows an inclined with respect to flow deployment of a wire into the wellbore;

FIG. 13 shows multiple wires fed into the wellbore;

FIG. 14*a* shows an axial withdrawn spindle for wire;

FIG. 14*b* shows a semi-spherical spindle of wire.

In the drawings, embodiments are illustrated by way of example, it being expressly understood that the description and drawings are only for the purpose of illustration, and are not intended as a definition of the limits of the invention.

DETAILED DESCRIPTION

FIG. 1*a* shows a drill rig 1 at sea level 6 with a riser 3 down to a blowout preventer ("BOP") 2 near the sea floor 5. In FIG. 1*b* the oil rig 1 is removed catastrophically leaving a BOP 2 and broken riser 3 with a break 7 that leaks hydrocarbon fluids 7*a* into the surrounding environment. The blowout preventer 2 is intended to choke the flow by activating a series of rams 4 (annular 4*c*, blind 4*b*, and shear 4*a*) intended to obstruct the flow. It is possible, however, for such rams to fail in ultimately choking the flow.

FIG. 2*a* is a perspective view of a flow limitation device 100 placed below the blowout preventer 2 and coupled to an access port 11 on the casing 8 below the BOP 2. In some implementations, the access port 11 is designed to be compatible with the structures described below to allow direct coupling. In some implementations, coupling the device 100 to the access port 11 is accomplished by means of an adapter. In some implementations, the device 100 could also be coupled directly to a BOP 2 if the BOP 2 had an appropriate connection port.

Position control thrusters 25 can be used to maneuver the device 100 to engage the access port 11. Although the configuration of FIG. 2 shows the access port 11 above the sea floor 5 and below the blowout preventer 2, the device 100 can couple directly to the BOP 2.

FIGS. 2*a* and 2*b* respectively show an angle view and close up of the device 100 connected to the access port 11 on the casing 8. In some implementations, the machine housing is shaped to be able to withstand high pressures. In some implementations, the shape of the housing is cylindrical 12*a* with hemispherical caps 12*b* for withstanding high pressures. The cylindrical section of the housing 12*a* has ports for the actuator arms 33 and pressurizing unit 26. A pressure port 12*h* on the housing is used to connect a pressurizing unit 26 to raise the internal pressure of the device 100.

FIG. 2*c* shows an actuator hand 33*a* on the actuator arm 33 used to open the feeding valve 12*c*. Alternatively, Remotely Operated Vehicles (ROV) can be used to open the feeding valve 12*c* and casing port valve 21 or the valves 21, 12*c* can be engaged using hydraulic actuators (not shown). Opening the feeding valve 12*c* and port valve 21 expose the feeding path for the wire 16 into the wellbore.

The housing unit 12 can be designed in several ways. For example, FIG. 2*d* shows a housing unit 12 where the top section 12*g* is removable and the thrusters 25 are mounted on the main section.

FIGS. 3*a*, 3*b*, 3*c*, and 3*d* show an example alignment method and mechanism between the access port 11 and the machine anchoring section 12*d*, done using an alignment cone 28*a*. The access port 11 has the receiving cone shape 28*b*. The machine anchoring section 12*d* has the male alignment cone 28*a*. After the alignment cone 28*a* is fully engaged in the access port 11, the device 100 anchors itself to the port 11. FIG. 3*a* shows the mating cross section of the access port 11 to the housing anchoring section 12*d*. When the valves 21*a* and 12*e* are opened the channel 28*d* is cleared to feed the wire 16 into the wellbore.

FIGS. 3*b* and 3*c* also show the features used for anchoring in the access port 11 and machine anchoring section 12*d*. On the access port 11 there is a groove 31*c* that is used to engage spring pins 31*a* in the machine anchoring section 12*d*. Slots 20*c* in the groove 31*c* allow for disengaging the device 100 by rotating 20*d*. The anchoring section 12*d* holds the counter part of the locking mechanism 31. FIG. 3*c* shows one of the engaging pins 31*a* that is spring 31*b* loaded. The device 100 can also disengage by pulling the engaging pins 31*a* using a pull handle 31*e* activated externally, such as by the robot arms 33 on the device 100. Once the pin 31*a* gets retracted, the spring 31*b* exerts a force outwards; therefore, a locking anchor 31*d* is used on the pin 31*a* to keep it from engaging. A chamfer 31*f* could be used to improve the compression of the locking anchor 31*d*. Alternatively the locking pins 31*a* can be engaged and disengaged using a hydraulic piston system (not shown) whose design would be clear to one skilled in the art of hydraulic systems.

FIG. 3*d* shows a cross section of the male alignment cone 28*a* that is part of the machine anchoring section 12*d*. O-rings 28*c* at the tip of the alignment cone 28*a* are used to seal the interface between the device 100 and the access port 11. The seal takes place at a small diameter so the axial forces from the high pressure inside the wellbore will not create too large a force on the locking mechanism 31.

FIGS. 4*a*, 4*b*, and 5 show a cross section of the machine housing 12 and pressurizing unit 26 exposing the modules of the device 100 feeding wire 16 into the wellbore. In some implementations, the device 100 is assembled at the surface and fluid filled, for example with oil as is customary in the art of pressure compensated devices used at great depth, so there are no air pockets in the device 100 to prevent external pressure induced stresses in the system. Furthermore, when the device 100 is coupled to the access port 11 and access valves 21*a* and 12*e* are open, even though the wellbore pressure may be much greater than the oil pressure inside the device 100, because the device 100 is fluid filled there will be no sudden flow of wellbore fluids into the device 100. The cylindrical body 12*a* with hemispherical 12*b* ends will then be able to withstand the potentially tremendous differential pressure between the well and the surrounding sea. Bolted flanges 27 with o-rings 27*a* are used to seal the housing 12.

If a differential pressure exists between the device 100 and the flow field 10 it pushes on the wire 16 and may cause it to buckle and jamb before the wire 16 enters the wellbore. However, if the pressure inside the device 100 is near or greater than the pressure inside the wellbore, the wire will not buckle or jamb until it enters the flow stream 10. Thus, in some embodiments, the device 100 is fully enclosed and pressurizable to a desired pressure.

The device 100 includes four modules: 1) wire feeding, 2) wire spindle, 3) pressurizing unit, and 4) controls/power system.

The wire feeding module includes a pair of motors 22 driving wheels 13 used to feed the wire 16 into the wellbore. In some implementations, the driving wheels 13*d* are placed close to the wellbore entry region 9 in order to reduce the chances of the wire buckling prior entering the wellbore. Wire guides 18 are also used to prevent the wire 16 buckling inside of the device 100. The entire feeding unit is mounted on plates 13*c* that are connected to the front hemisphere of the housing 12*b*.

The wire spindle 14 is similarly held by a matching mounts 14*c* that connects to the housing 12. The feeding mechanism 13 of the device 100 consists of two rotating wheels 13*d* to pull the wire 16 from the spindle 14 and push it into the flow stream 10.

The pressurizing unit 26 can be attached to the housing 12*b* to equalize the pressure between the interior of the housing 12*a*,12*b* and the wellbore, or raise the interior housing 12*a*, 12*b* pressure above that of the wellbore to aid with feeding the wire 16 into the flow stream 10. In some implementations, fluid could be taken from the environment and pressurized. In this case, the pressurizing unit has an entry port 26*a* that can interact with the environmental fluids, e.g. using a solenoid valve 26*b* or other appropriate structure. The fluid travels thru pump inlet 32*a* where it can be filtered and pressurized by the pump 32 and then exits the pump 32*b* into the housing 12*a*, 12*b* internal volume where the fluid flows into the wellbore and helps carry the wire 16 with it. In some implementations this fluid would be seawater and thus the above mechanisms have properties sufficiently resistant or robust to accommodate seawater; such as corrosion resistance, temperature deformations, salt crystallization, no bearing surfaces between moving members able to operate in seawater, and electronics sealed against shorts.

The housing 12*a* and 12*b* also holds batteries and electronics 34 in a container 26 suited for the pressurized environment. The electronics 34 includes some or all components of a control system, including communication, signal processing, onboard computing, etc. In what follows, various controllable components (e.g., drive rollers, motors, thrusters, etc.) are described. The control system is in data communication with the various controllable components described herein and is operable to control these components. The control system can be implemented in any known fashion; e.g., via an embedded system, a general-purpose computer, special-purpose control circuits, etc. In some implementations, the control system is self-contained on the device 100. In some implementations, various components of the control system are remote from the device 100. For example, in some implementations the electronics 34 can include can include a receiver (e.g., a radio receiver) or a physical connection (e.g. by metallic or fiber optic cable(s)), either of which being operable to receive control instructions from a remote location. In some embodiments, the electronics 34 include an autonomous control within the device 100 activated in the event that communication interrupted. In some embodiments, the electronics 34 can be used to actively modify operating parameters (e.g. feed speed, internal pressure, etc.) to enhance the entanglement based on user input and monitoring the BOP 2 and user inputs.

FIG. 5 shows a close up view of the drive wheels 13*d* pushing the wire 16 through a wire guide 18 and two open ball valves 12*e* and 21 into the wellbore entry region 9.

In some embodiments, the wire feeding mechanism 13 can change the geometry of the wire 16 being fed as shown in FIGS. 6*a*, 6*b*, and 6*c*. For example, knurled or otherwise textured driving wheels 13*d* form surface features on the wire 16*b* that enters the flow stream 10 which reduce the amount of energy it takes to buckle and improve entanglement cohesion. As the wire 16*b* enters the flow stream 10 it takes less force for it to buckle and entangle and the rough surfaces more readily entangles and holds together. Greater pressure in the housing 12*a*,12*b* than in the wellbore, as discussed above, enables the wire 16 to be formed to easily buckle, yet allow it to be fed into the wellbore.

The feeding mechanism feeds the wire at a controllable rate. In some embodiments, the velocity of the wire as it is fed is between 0.1 and 100 times the fluid velocity in the wellbore. In some implementations, the wire's diameter is between 0.1 mm to 10 mm. In some implementations, the wire's stiffness varies from relatively plastic (e.g., that of nylon) to relatively stuff (e.g., that of steel). Various other suitable wires can be found in the co-pending application discussed and incorporated by reference above.

The drive wheels 13*d* can also be used to impart a curl on the wire 16 as part of the feeding process. The driving wheels 13*d* can be controlled to run at different speeds by varying the drive motors' 22 speeds in order to create shear stresses on one side of the wire thus generating a curvature in the wire 16, which will encourage more entanglement in the wellbore. Differential drive wheel speeds can also be obtained by having the two driving wheels 13 coupled together with different sized gears 13*f* and 13*g*, as illustrated in FIG. 6*c*, so only one drive motor 22 is needed. This results in a particular relative velocity (based on the relative sizes of the gears) is maintained amongst the wheels.

In some embodiments, two motors 22 are used with gears also coupling the drive wheels 13*d*, so if one motor 22 fails, the other motor 22 can still actuate both drive wheels 13*d*. The fail safe ensures that both drive wheels 13*d* are actively feeding even if one motor 22 fails.

Referring to FIG. 7, in some embodiments one of the driving wheels 13*d* is mounted on a spring flexure 30, operable to maintain a desired or controllable force between the wheels, and that allows pressing the wire 16 at a known or controlled preload. The flexure 30 is on both sides of the wheel mount plate 13*c* and a pin 30*a* holds the driven wheel 13*e*.

Referring to FIGS. 8*a*, 8*b*, 8*c*, in some embodiments, the device 100 is connected to existing BOP 2 ports such as the choke/kill port valves 50*a*. The device 100 can be connected straight, as in FIG. 8*a*, or meandering, as in FIG. 8*b*, to the BOP 2. The straight configuration, FIG. 8*a*, includes a port that provides access straight to the wellbore. The meandering configuration, FIGS. 8*b*, 8*c*, includes an access port that via additional piping 50*b* with bends provides wellbore access.

In some implementations, the device 100 includes a wire passage structure through which the wire 16 passes on its way to the wellbore. In some implementations, the wire passage structure includes a "proboscis" system 90, shown fully in FIG. 9*e* and components in FIGS. 9*c*, 9*d*, and 10*a*-10*d*, which can be used to feed the wire 16 directly into the wellbore to be entangled. The term proboscis is defined here to be a hollow member that extends from the device 100 to feed through the BOP 2 system to bring the wire 16 directly to the point in the wellbore where it is to be injected. It thus prevents the wire 16 from prematurely buckling before it gets to the flow stream 10.

The device 100 to feed a proboscis 90 that maneuvers into place is shown in FIG. 9*a*. The device 100, as shown in FIGS. 9 and 10, can be subdivided into six modules: casing, anchoring 12*h*, access valve 60, proboscis feeder 70, spindle 80 and proboscis 90.

The casing module encompasses the housing 12*a*, 12*b* which provides the structural support for the pressurized container, and connects to peripherals such as the thrusters 25 and control arms 33. In some embodiments, peripherals are designed to read sensors external to the device 100 and provide a feedback to the electronic 34 control system. The casing module is connected to the anchoring module 12*h* via the anchoring section 12*d*.

The anchoring module 12*h* is shown in detail in FIGS. 9*b*, 9*c*, and 10*a* is used to connect the device 100 to a standard flange on the port valves 50*b*, as illustrated in FIG. 10*a*. The anchoring section can include a mechanism such as a quick connect fitting. As the device 100 approaches a standard flange the alignment cone 28 and a taper on the wedge housing 12*e* are used to center the flange to anchoring module 12*h*. As the flange gets centered it slides the locking wedges 31*a* outwards. The locking sleeve 12*i* is at this point in the engagement configuration that allows for the locking wedges 31*a* to move outwards. At full engagement, i.e. when the flange touches the anchor mounting plate 12*k*, the locking wedges 31*a* are activated and move inwards hydraulically and the locking sleeve 12*i* is placed in the anchoring configuration that does not allow the locking wedges 31*a* to move outward. In some embodiments the inwards motion of the locking wedges 31*a* is done via a spring system as illustrated earlier. An o-ring seal 28*c* between the flange and anchor mounting plate is used to prevent hydrocarbons from leaking to the environment. In some embodiments, the o-ring seal 28*c* can be replaced with an hydraulic seals that can be pressurized to help ensure zero leakage.

Referring to FIGS. 9*c* and 10*a*, the access valve module 60 connects to the anchoring module 12*h* and forms an interface coupling between the access port 50*a* to the BOP 2 and the proboscis feeder module 70. The cylindrical access valve 62 can be opened and closed electronically via a motor 61. The cylindrical access valve 62 can be replaced with a standard ball valve 12*c*.

The proboscis feeder module 70, FIGS. 9*a*, 9*b* and 9*c*, is responsible for gripping the body 90*b* of the proboscis 90 and feeding it into the casing entry region 9 leading to wellbore. The proboscis feeder module 70 includes a mounting plate 71 and brackets 71*a* that hold all the components which include a guide 77 for the proboscis body 90*b*, drive motor 72, gearing 74, and proboscis housing 76. The feeding process is accomplished by driving a pair of drive rollers 75 with a motor 72. In some embodiments the drive rollers 75 are synchronized using gears 73. The gears 73 are secured to a rotating shaft using couplings 73*a*. In some embodiments, the drive roller 75 have gripping features 75*a* for pushing the proboscis body 90*b* for deployment, and pulling proboscis body 90*b* during extraction.

FIG. 9*c* shows the un-deployed configuration of the proboscis head 90*a* inside of the device 100. The head of the proboscis 90*a* is placed prior to the access valve module 60. When the cylindrical access valve 62 is open the proboscis head 90*a* can move forward by activating the pair of drive wheels 75 that push on the body of the proboscis 90*b*. The activation of the proboscis drive system unwinds the length of the proboscis body 90*b* from the spindle module 80 until the full length of the proboscis 90*b* is inserted. The length of the proboscis body 90*b* is specified for the length necessary to reach the wellbore.

In some implementations, the spindle module 80, shown in FIGS. 9*a*, 9*d*, 9*g*, houses the length of the proboscis body 90*b*, and the consumable wire spindle 85 in a set of concentric independently driven semispherical shells. The spindle module 80 is assembled on a mounting plate 81 that has a guidance aperture 81*a* for the proboscis body 90*b*. Brackets 82 are used to hold the mating spindle shells 80*b* which consists of two hemispherical domes that enclose the consumable wire spindle 85. Exterior ridges 80*a* on the shells 80*b* allow for the proboscis body 90*b* to be wound on the spherical surface. As illustrated in FIG. 9*g* the clearance space between the spindle shells 80*b* and the mounting plate region 81*b* does not allow the proboscis body 90*b* to travel along the groove channels 80*a* and entangle. The tail of the proboscis 90*c* is connected to the spindle 80*c*, FIG. 9*d*.

FIG. 9*g* shows the independent drive system for the spindle module 80. The drive motors 83*a* and 83*b* are mounted to the raised brackets 82 using a mount interface 84. Motor 83*a* is used to drive the center shaft 88 where the consumable wire 16 is would on via a coupling 89 and bushing 86. Motor 83*b* is used to drive the spindle shells 80*b* via a coupling 87. Therefore, after feeding the proboscis body 90*b* with motor 83*b*, the consumable wire spindle 85 can still be driven with motor 83*a*.

Although FIGS. 9*a-d* show the spindle module 80 as a spherical shells 80*b* it can also be cylindrical or another shape. However, the spherical shape 80*b* allows for a more efficient use of the available volume. Also the connection between the proboscis tail 90*c* and the spindle 80 can be at any point on the equator of the spindle 80. Changing the location of the proboscis tail 90*c* allows for greater lengths of proboscis body 90*b* to be rolled on the spindle shells 80*b*. The length of the proboscis body 90*b* wrapped in the spherical shells 80*b* can be calculated using the full and truncated spherical helix.

FIG. 9*e* shows the three sections of the proboscis 90: head 90*a*, body 90*b* and tail 90*c*. The head of the proboscis 90*a* is designed to maneuver the path to the wellbore. The enclosure of the proboscis head 90*a* consists of four subsections, as shown in FIG. 10*b*. The leading section 91*a* is the driver section that is the front most region. The leading edge 91*a* contains the drive rollers 94 that pull the wire 16 that is passing through the proboscis body 90*b* and feed it into the wellbore. The motors 92 activating the drive system are mounted to the leading edge 91*a* with a mounting bracket 92*a*. The leading edge 91*a* is allowed to flex with the use of a flexible mid body 91*b* that connects to the rear of the proboscis head unit 91*c* and 91*d*. The body of the proboscis 90*b* is connected to the section 91*d* at the rear. A flexible guide 93 is used to transfer the wire 16 across the length of the proboscis head 90*a* into the drive wheels 94.

The body unit 90*b* of the proboscis 90 joins the head 90*a* section to the tail 90*c* section. It can consist of a flexible member 90*b* whose stiffness is calculated to allow for travel in the choke/kill line path. In some embodiments, e.g. as shown in FIG. 9*e*, the flexible hose 90*b* can bend, and the exterior surface is coated to reduce friction. Alternatively, if the head unit 90*a* is small enough and choke/kill line path large enough, the head unit 90*a* can be a rigid. The internal section of the body 90*b* is hollow to allow that transmission of the entanglement wire 16 to the wellbore. The casing of the body 90*b* can be used to carry the power/signals 92*b* to operate the active drive system at the head 90*a* of the proboscis, FIG. 9*f*.

The tail unit 90*c* of the proboscis 90, FIGS. 9*d* and 9*e*, can also contain an active drive system. The tail 90*c* drive system pulls wire 16 from the wire spindle 85 and feeds it into the internal cavity of the body 90*b* of the proboscis. The wire 16 is thus fed through the proboscis body 90*b* using both the push feature at the tail 90*c* and the pull feature at the head 90*a* of the proboscis.

FIG. 10*a* shows the valve module 50*a* in the open configuration and the proboscis head 90*a* unit maneuvering around a 90 degree bend.

FIG. 10*b* shows the flex regions 91*b*, 93 of the proboscis head 90*a* allowing for deformation of the structure without interfering with the wire 16 feed operation of the unit.

FIG. 10*c* shows the proboscis head 90*a* at the casing entry region 9, in this configuration the drive wheel 94 of the proboscis head 90*a* activate and begin to continuously feed wire 16 directly into the flow stream 10. The consumable wire 16 is taken by the flow stream 10 and can begin to entangle in the flow stream given a natural obstruction.

FIG. 10*d* shows the drive system for the proboscis head 90*a*, which consists of two motors 92, each driving a feed roller 94 via a worm gearing system 95, 95*a*. A pair of dc motors 92 is used in some embodiments to push the wire 16 into the wellbore. While the use of two motors 92 may add cost and complexity, it provides a safe guard for the drive systems. For example, in some embodiments the drive system is geared together such that only one motor 92 is needed to drive both wheels 94, as discussed earlier. Having independent control of the rollers 94 can allow for curling the wire 16 as it enters the wellbore. The proboscis head 90*a* motors 92 could be run at the same speed or have a differential speed that will cause a shear stress on the wire 16 thus implementing a curve on the wire 16. As the head 90*a* pushes the wire 16 into the wellbore the motors 92 at the tail 90*c* of the proboscis are also activated to pull wire 16 from the spindle 85 and feed it into the body of the proboscis 90*b*.

After completing the plugging operation, the proboscis 90 can be retracted into the device 100 by activating the proboscis drive wheels 75 in reverse and simultaneously activating the spindle drive motor 83*b* to wind up the body 90*b* of the proboscis on the spindle shells 80*b*. The winding gate 81*a* is used to guide the proboscis body 90*b* to the groove 80*a*. In the case of last resort the body of the proboscis 90*b* can be cut off via the existing access valves 50*a* and the port valve 62 of the device 100.

FIGS. 11*a*-11*d* shows the cross section of the BOP 2 with the generated entanglement occlusion generated by feeding the continuous medium into the wellbore. Observations in the laboratory have shown the following non-intuitive results: There are at least three modes of entanglement, as illustrated in FIGS. 11*a*, 11*b*, and 11*c*. The first mode in FIG. 11*a* is wire 16 fed into the wellbore, which entangles upstream at an obstruction such as the failed rams in the BOP 2. In the second mode the wire 16 starts entangling shortly after entering the wellbore. The shape of the entanglement is similar to an infinity sign 23*d* or the shape of the number eight. The third mode of entanglement also takes place near the entrance to the wellbore; however, the buckling wavelength is much shorter which allows for more wire 16 to be fed into the region. The entanglement mode will be a function of the fluid velocity in the wellbore and the wire 16 properties and injection speed.

In some cases, it can be desirable to let the fluid flow 10 take the wire 16, and allow it to entangle relatively far down stream of the insertion port 9, as shown in FIG. 11*d*. If an entanglement is generated at the insertion port 9, then the amount of force required to feed the wire 16 into the wellbore will increase as the entry region 9 is obstructed.

Although some embodiments show the wire 16 insertion in the radial direction normal to the length of the tube, in some embodiments, the wire 16 is inserted with a different angle of entry 17. This can improve entanglement by directing the wire 16 first along a direction more tangent to the inner wellbore where the fluid velocity near the wall is lower, and hence the wire 16 gets a chance to get into the wellbore and hang up on some feature in order to start the entanglement process. As shown in FIG. 12*a* by feeding the wire 16 at a chord angle 17 it allows for the wire 16 to coil around the wall where the free stream 10 velocity is lower. After a significant amount of wire 16 has been inserted there is a large surface area of the wire 16 in contact with the wellbore wall thus providing more anchoring for the entangling nest 23. FIG. 12*b* shows the wire 16 feed at an inclined direction with respect to the flow stream 10 which can reduce the chances of the wire 16 being carried out by the fluid stream 10 without entangling. A combination on chord and inclined feeding can be done to improve entangling.

For more rapid closure of the wellbore, multiple wires 16 can be fed simultaneously as illustrated in FIG. 13. Inserting multiple wires 16 can be done such that it creates a mesh like structure obstructing the fluid flow 10. As the mesh grows by feeding more wire 16, a plug is created that clogs the wellbore. This embodiment would require multiple machines to be used, which has the advantage of redundancy should one machine fail.

In another embodiment, the wire holder can be changed to reduce the number of parts and moving components. For example, as shown in FIG. 14*a*, the wire spindle 14*c* can have a configuration 14*b* can be such that the wire 16 can be pulled in the axial direction. This embodiment eliminates the need for a rotating spindle. The geometry in which the non-rotating wire spindle can also be diverse. FIG. 14*b* shows a semispherical wire spindle 85 that can be extracted from the center, similar to some yarn balls.

After feeding the wire 16 and bringing the uncontrolled flow under control, the valves 12*e*, 21*a*, 53, 62 should have to have the ability to cut the wire 16 and proboscis 90 as part of the closing process. If a metal or ceramic ball valve or gate valve is used, then the valve 12*c*, 21*a*, 53, 62 can also be used to shear through the wire 16 with sufficient actuation force applied. This would be advantageous so the device 100 can then be disconnected after being used.

Further modifications will also occur to persons skilled in the art, and all such are deemed to fall within the spirit and scope of the invention as defined in the appended claims.

What is claimed is:

1. A method for incrementally reducing uncontrolled flow in a flow device by feeding a wire into a flow device to entangle and form a plug, the method comprising:

coupling a machine to an access point on the flow device, the flow device including a fluid passing through the flow device at a flow rate, and the machine including a deployable stock of a wire and a drive system configured to drive the wire in a deployment direction into into the flow device, wherein the flow device includes a wellbore for hydrocarbons; and feeding the wire from; and the deployable stock into the flow device at an inclined direction to a flow stream of the fluid within the flow device, wherein feeding the wire includes feeding the wire at a rate between 0.1 and 100 times the flow rate of the fluid in the flow device.

2. The method of claim 1 wherein the wire includes a plurality of sections including one or more first sections that preferentially flex and buckle, one or more second sections that contain a wide section that entangles and builds an increasing resistance to flow as additional lengths of the wire are fed into the flow device, and one or more sections to pack and seal areas left by other sections of the wire.

3. The method of claim 1, further comprising equalizing a pressure between an interior of the flow device and an inside of the machine.

4. The method of claim 1, wherein feeding the step of feeding the wire occurs in response to a failure event in said flow device that causes the uncontrolled flow.

5. The method of claim 4, wherein the failure event includes the flow rate increasing beyond a pre-defined threshold.

6. The method of claim 4, wherein the failure event includes a control failure of a safety component of the flow device.

7. The method of claim 1, wherein a beginning of the wire includes a stinger to promote entanglement as the wire feeds into the flow device.

8. The method of claim 1, wherein the wire includes one or more sections of metal configured to preferentially flex and buckle.

9. The method of claim 1, wherein the wire includes one or more sections of 12 gauge aluminum wire.

10. The method of claim 1, wherein the wire includes one or more sections formed of a flat ribbon wire coated at least in part with a swellable material.

11. A method for incrementally reducing an uncontrolled flow in a flow device by feeding in a wire to create a tangled wire mass that generates a mechanical plug, the method comprising:

coupling a machine to an access point in the flow device, the flow device including a fluid passing through the flow device at a flow rate, and the machine including a proboscis, deployable stock of a wire and a drive system configured to drive the wire in a deployment direction into the flow device, wherein the flow device includes a wellbore for hydrocarbons;

equalizing a pressure;

between an interior of the flow device and an inside of the machine;

extending the proboscis into a port of the access point; and continuously feeding the wire from the deployable stock into the interior of the flow device to generate a tangled wire mass, wherein the wire includes a plurality of sections including one or more first sections that preferentially flex and buckle, one or more second sections that contain an anchor to guide the wire into the flow device, and one or more sections to pack and seal areas left by other sections of the wire.

12. The method of claim 11, wherein the proboscis includes a drive system to navigate and extend the proboscis into the flow device.

* * * * *